US006571519B1

(12) United States Patent
Diffrient et al.

(10) Patent No.: US 6,571,519 B1
(45) Date of Patent: Jun. 3, 2003

(54) PANEL PARTITION SYSTEM WITH CENTRALIZED POWER AND COMMUNICATION DISTRIBUTION

(75) Inventors: Niels Diffrient, Ridgefield, CT (US); Timothy J. Bouche, Green Bay, WI (US); Andrew J. Kopish, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/092,474

(22) Filed: Jun. 5, 1998

(51) Int. Cl.[7] ..... E04B 2/74; H02G 3/22

(52) U.S. Cl. ..... 52/239; 52/243.1; 52/36.1; 160/135; 362/127; 174/45 R; 174/48

(58) Field of Search ..... 52/238.1, 239, 52/28, 36.1, 71, 220.7, 243.1, 481.2, 282.2; 160/135; 256/26; 362/127, 145; 403/170, 217; 174/48–49, 45 R

(56) References Cited

U.S. PATENT DOCUMENTS

| | | | | | |
|---|---|---|---|---|---|
| 3,428,108 | A | | 2/1969 | Singer | |
| 3,559,352 | A | | 2/1971 | Magnuson | |
| 3,605,851 | A | | 9/1971 | Miles et al. | |
| 3,762,116 | A | | 10/1973 | Anderson et al. | |
| 3,828,937 | A | * | 8/1974 | Nash | 211/86 |
| 3,856,981 | A | | 12/1974 | Boundy | |
| 3,895,670 | A | * | 7/1975 | Bales et al. | 160/135 |
| 3,949,827 | A | | 4/1976 | Witherspoon | |
| 4,516,619 | A | | 5/1985 | Hasbrouck | |
| 4,601,145 | A | | 7/1986 | Wilcox | |
| 4,624,083 | A | | 11/1986 | Diffrient | |
| 4,771,583 | A | * | 9/1988 | Ball et al. | 52/239 X |
| 4,812,958 | A | * | 3/1989 | Rolfe et al. | 362/431 |
| 4,914,873 | A | * | 4/1990 | Newhouse | 52/36 |
| 4,932,172 | A | | 6/1990 | Maas | |
| 5,044,135 | A | | 9/1991 | Kroon et al. | |
| 5,105,594 | A | * | 4/1992 | Kirchner | 52/239 |
| 5,129,202 | A | | 7/1992 | Payne et al. | |
| 5,150,554 | A | | 9/1992 | Quinlan, Jr. et al. | |
| 5,155,955 | A | * | 10/1992 | Ball et al. | 52/239 X |
| 5,175,969 | A | * | 1/1993 | Knauf et al. | 52/239 |

(List continued on next page.)

*Primary Examiner*—Lanna Mai
*Assistant Examiner*—Winnie Yip
(74) *Attorney, Agent, or Firm*—Boyle, Fredrickson, Newholm, Stein & Gratz, S.C.

(57) ABSTRACT

A space dividing system includes a column and a series of partition panels adapted for interconnection with the column. The column includes an internal passage, and is adapted to receive wiring from a building for supplying power to a receptacle arrangement interconnected with the column. Adjacent panels are connected to the column at spaced locations, and the receptacle arrangement is exposed between the adjacent panels. The column includes a structural skeleton to which the receptacle arrangement is mounted, and a series of covers are releasably engaged with the structural skeleton for finishing the aesthetic appearance of the column. An adjustable height mounting arrangement is interconnected with the upper end of the column for connection to a ceiling to stabilize the upper end of the column. Each panel is in the form of a frame defining an opening within which a core is received. Cover members are releasably engageable with the frame members, and overlie the core so as to releasably maintain the core in position within the opening. End caps are mounted to upper and lower ends of the side frame members, and are utilized to mount various connectors to the panels for interconnecting the panels together and for providing stacking of panels on top of each other.

66 Claims, 22 Drawing Sheets

U.S. PATENT DOCUMENTS 5,362,923 A * 11/1994 Newhouse et al. ..... 52/239 X
5,394,658 A * 3/1995 Schreiner et al. ..... 52/239 X
5,423,151 A 6/1995 Caro et al.
5,511,348 A * 4/1996 Cornell et al. ..... 52/239
5,644,876 A * 7/1997 Walker ..... 52/220.7
5,675,949 A * 10/1997 Forslund et al. ..... 52/239 X
5,685,113 A 11/1997 Reuter et al.
5,689,926 A * 11/1997 Nichols ..... 52/239 X
5,740,650 A * 4/1998 Seiber et al. ..... 52/584.1
5,816,001 A * 10/1998 Goodman et al. ..... 52/239

* cited by examiner

FIG. 11
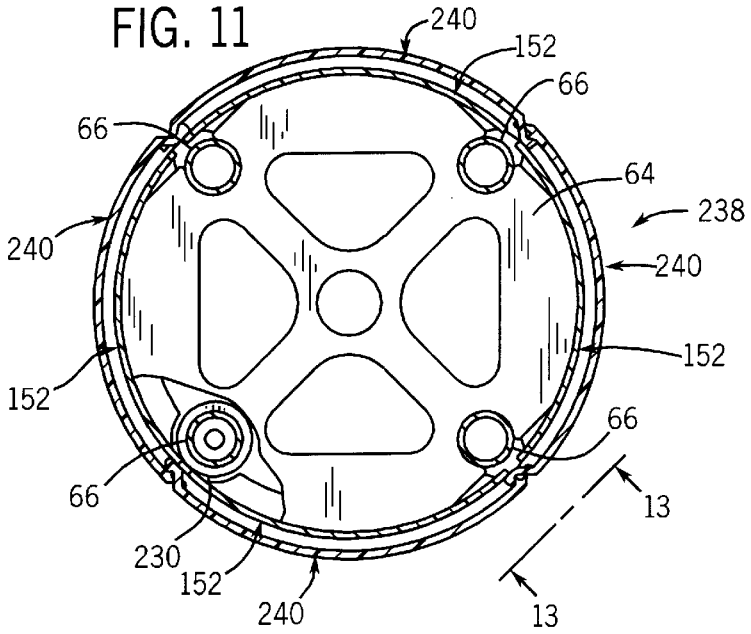
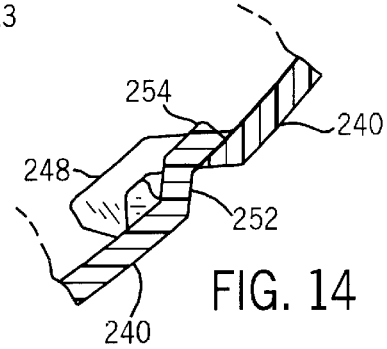
FIG. 14
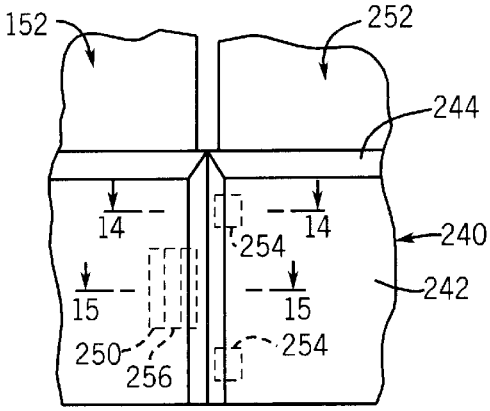
FIG. 13
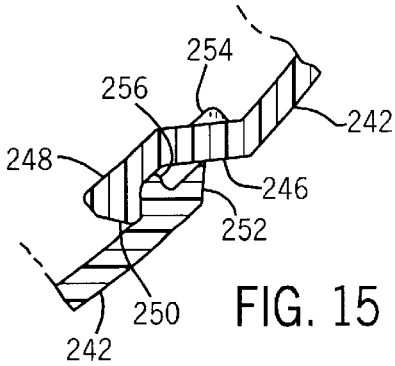
FIG. 15

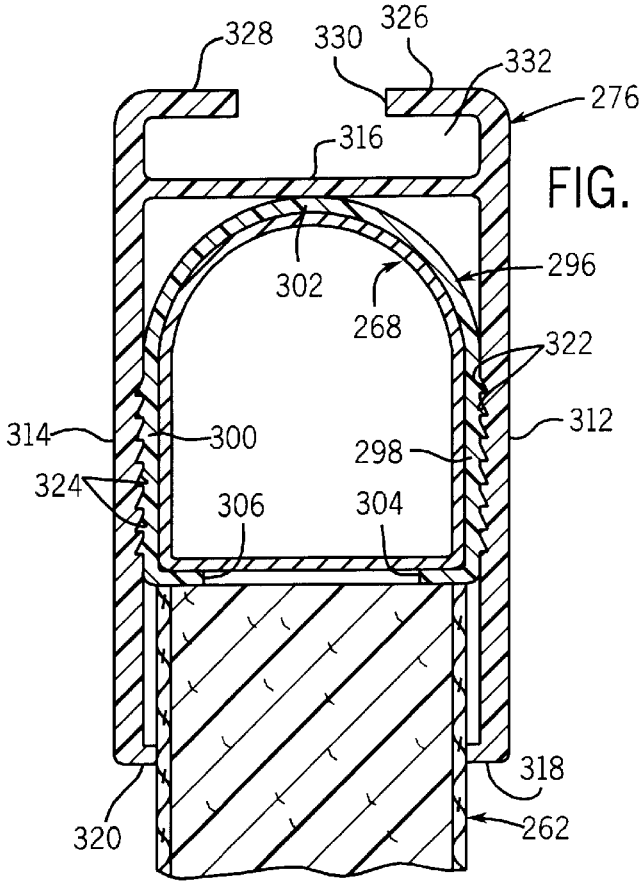
FIG. 19
FIG. 20
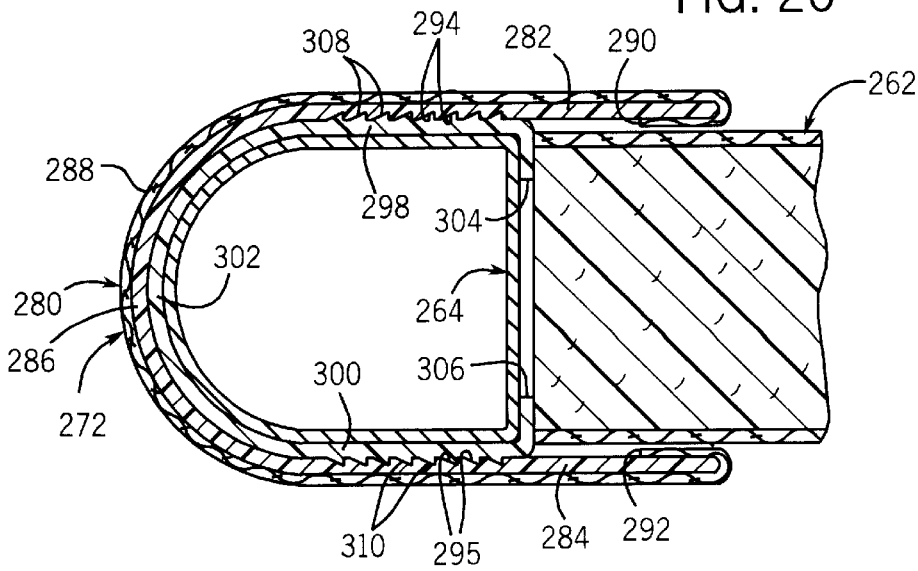

FIG. 21
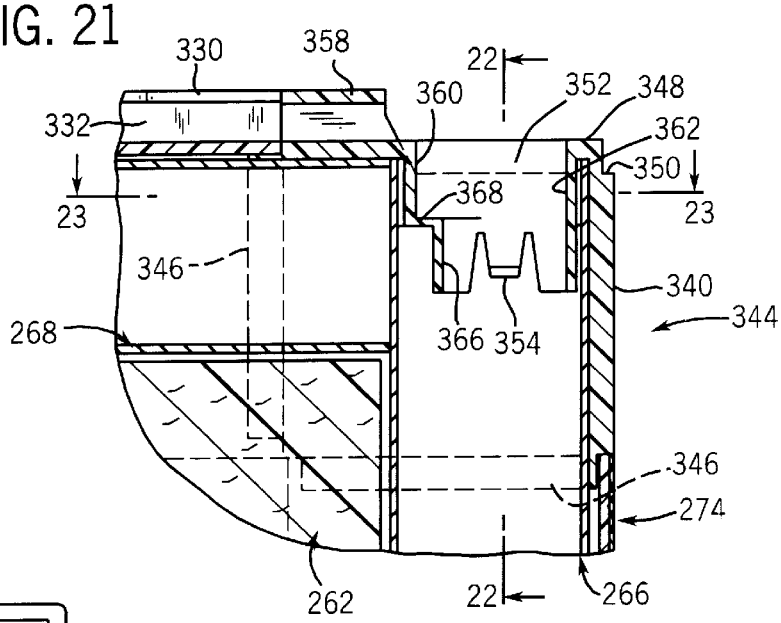
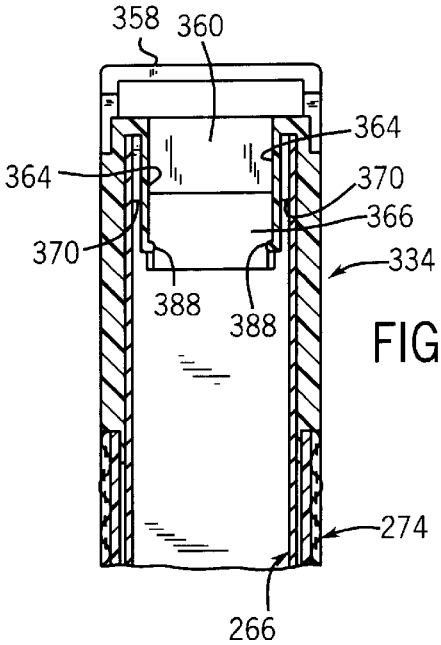
FIG. 22
FIG. 23
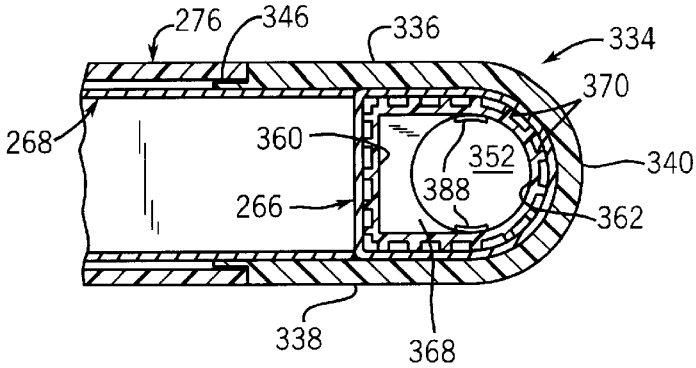

FIG. 25
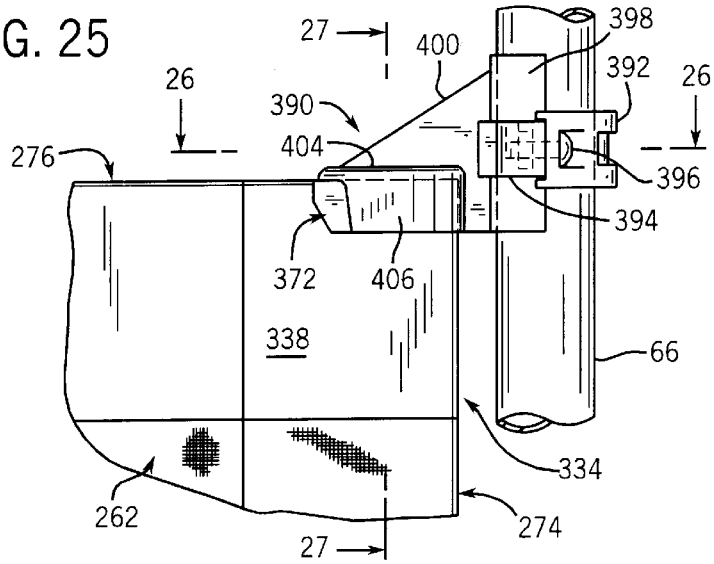
FIG. 26
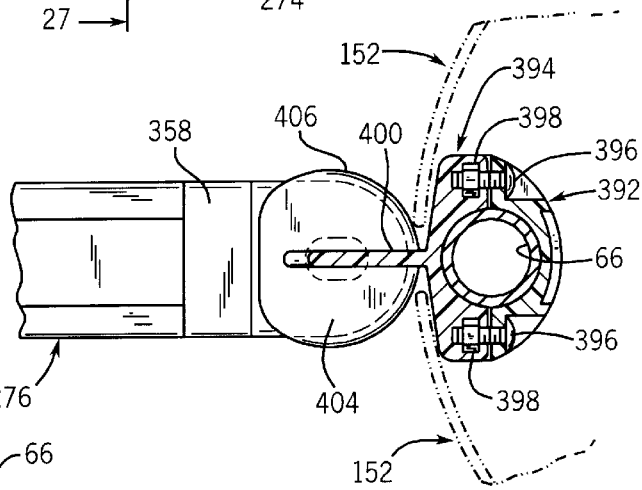
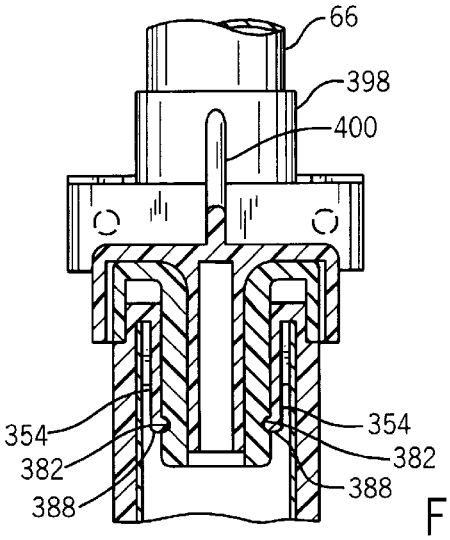
FIG. 27

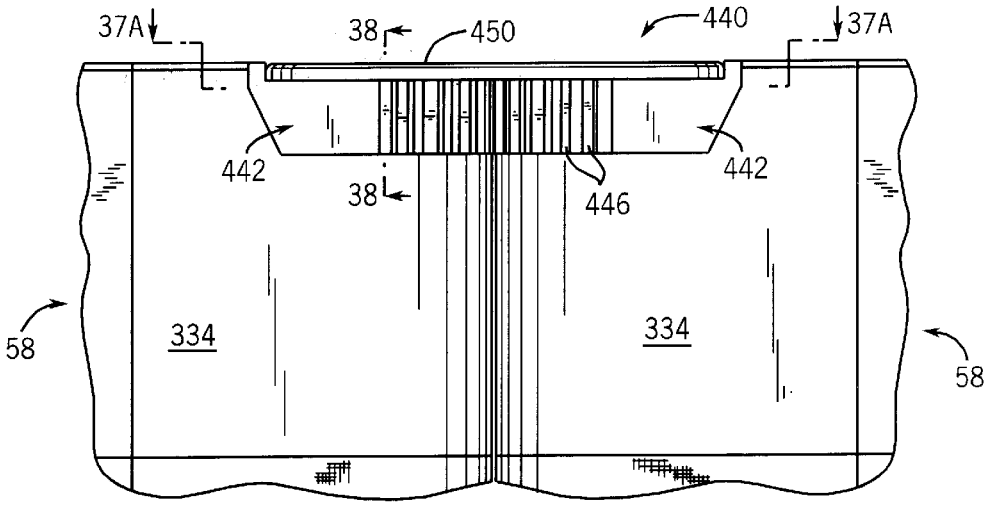
FIG. 35
FIG. 36
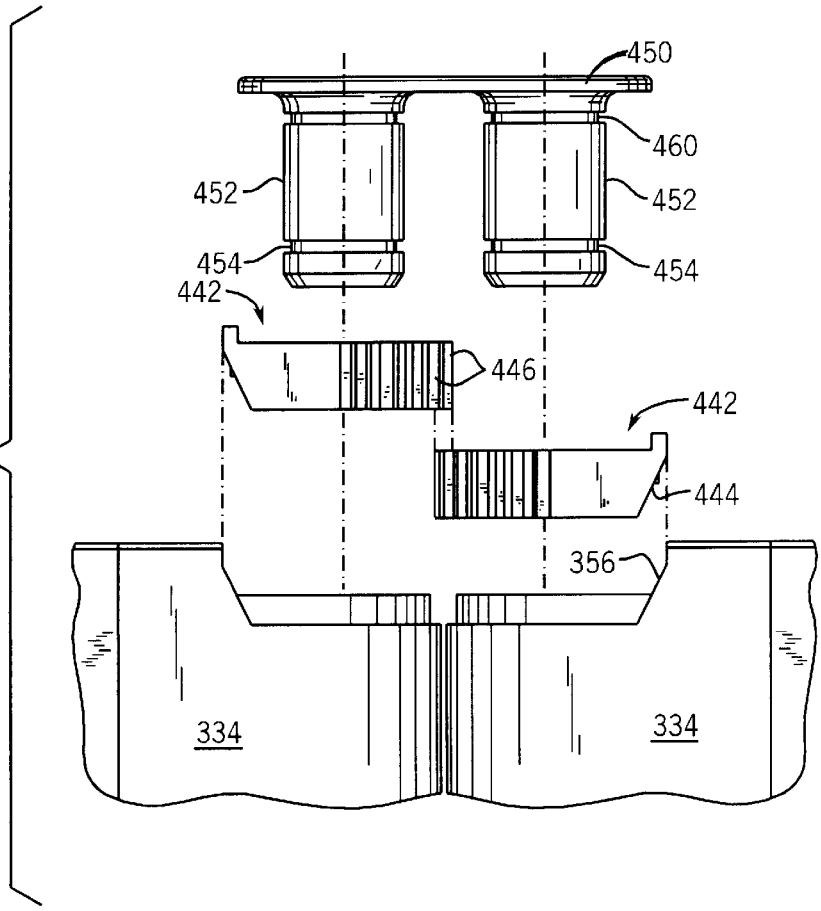

FIG. 39
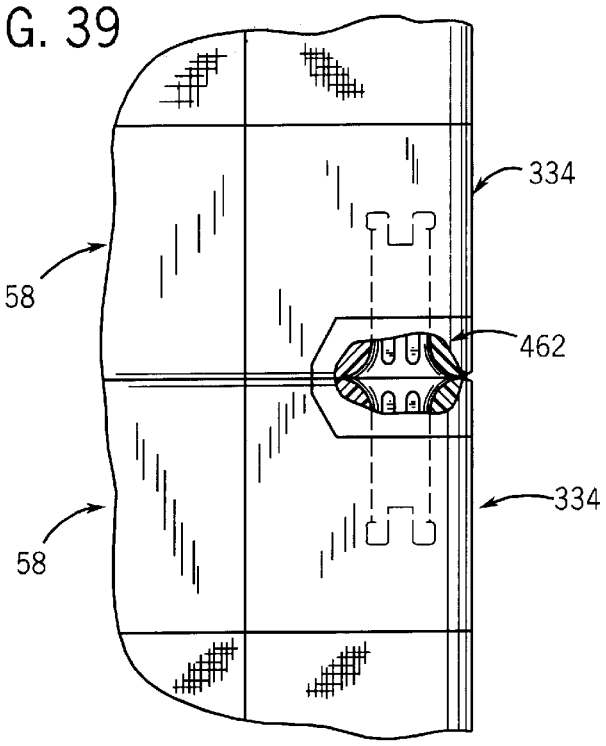
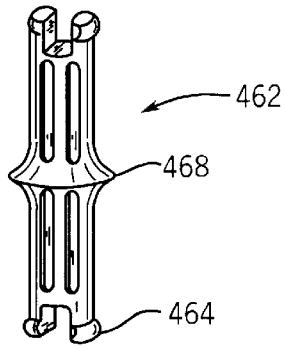
FIG. 40
FIG. 41
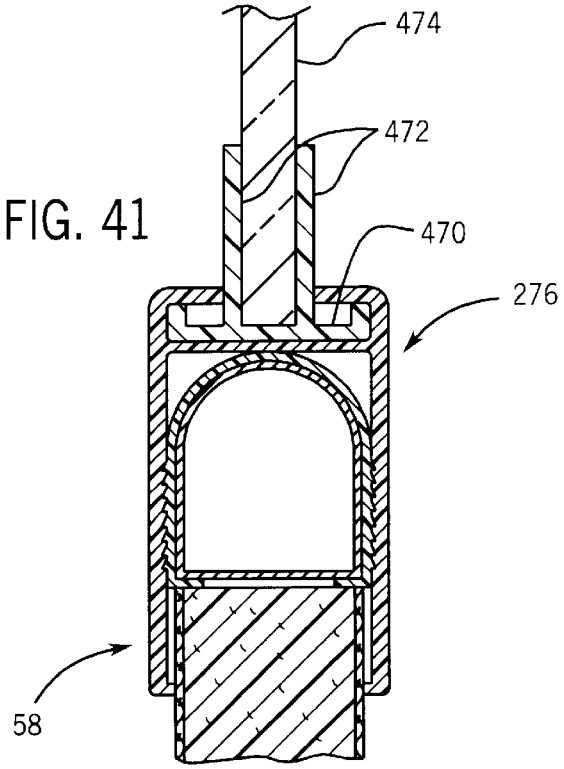

FIG. 42
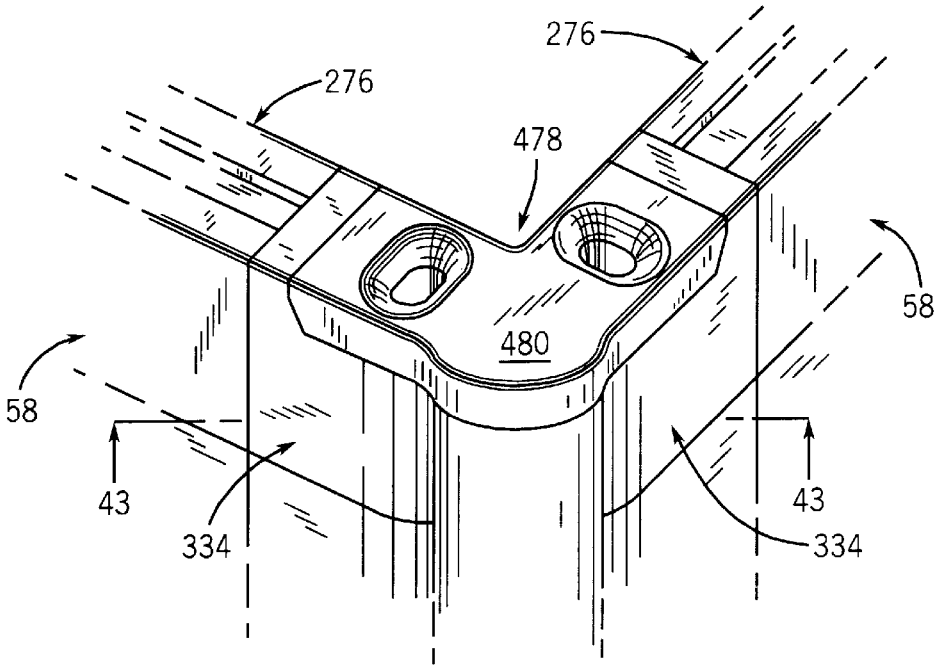
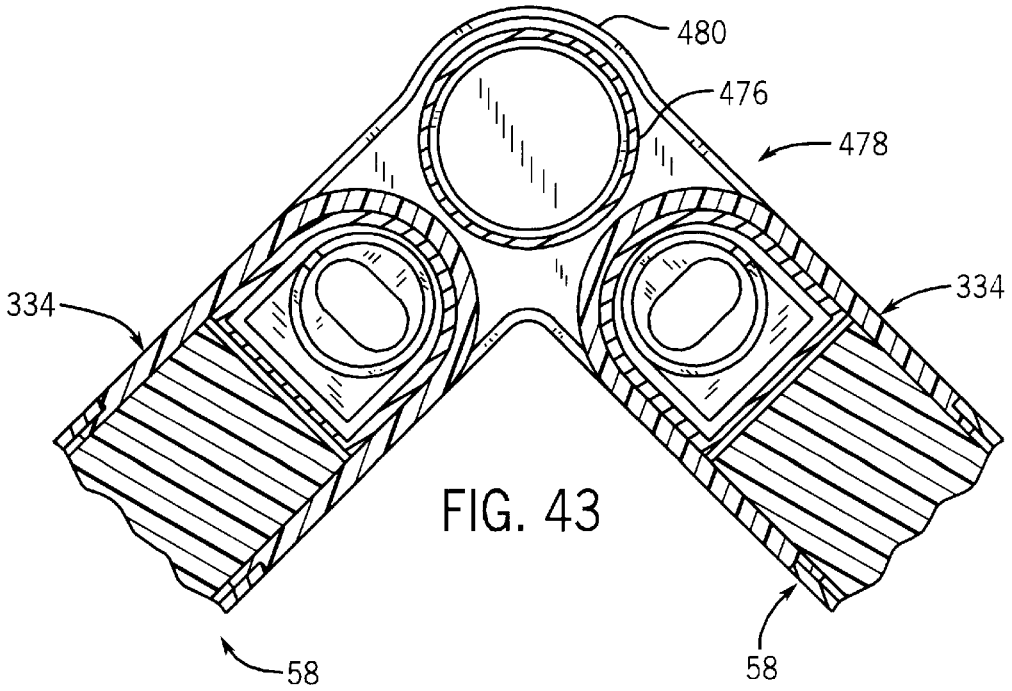
FIG. 43

FIG. 44
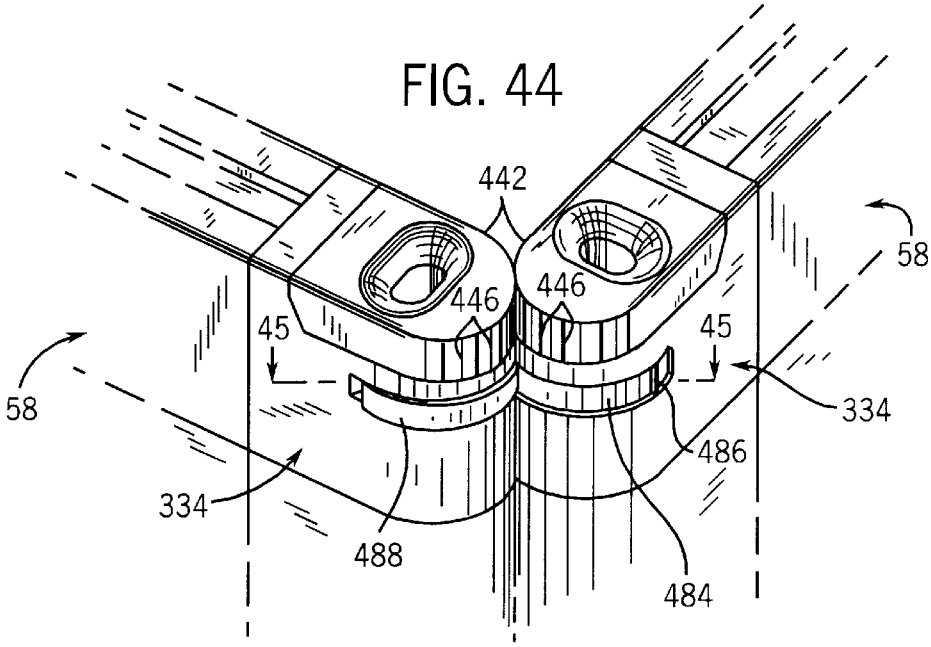
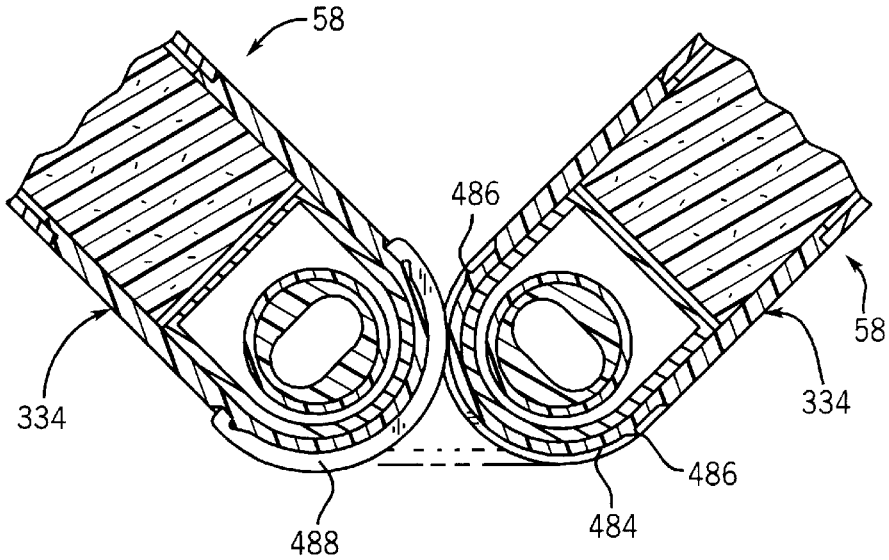
FIG. 45

PANEL PARTITION SYSTEM WITH CENTRALIZED POWER AND COMMUNICATION DISTRIBUTION

BACKGROUND AND SUMMARY OF THE INVENTION

This invention relates to a space dividing or partitioning system such as for use in an office environment, and more particularly to such a system incorporating power and communication capabilities.

A wide variety of office space partitioning or dividing systems are known. Many such systems include wall panels which are rigidly interconnected with each other to form a sectioned wall assembly. In such a system, it is common to provide a power distribution system toward the lower end of each wall panel, incorporating power receptacles at spaced locations. It is also known to provide power and/or communication distribution in each panel substantially at desk height. While this type of wall construction functions well and has met with success, it involves certain drawbacks. For example, it is necessary to connect the power and communication components of one wall panel with the power and communication components of an adjacent wall panel when constructing a wall, and to disconnect such components when reconfiguring the wall. Further, the cost of such wall panels necessarily includes costs for the electrical and communication components. In addition, the structural connections of adjacent panels can be time consuming to disconnect and reconnect each time the wall configuration is altered.

It is an object of the present invention to provide a space dividing or partitioning system incorporating a centralized power and communication distribution system. It is a further object of the invention to provide such a system which removes power and communication distribution from the partition panels, thus simplifying construction of the panels and reducing overall costs associated therewith. Another object of the invention is to provide such a system which can be quickly and easily reconfigured with a minimal amount of labor. Yet another object of the invention is to provide such a system incorporating a central column for providing both structural support as well as power and communication distribution. A still further object of the invention is to provide such a system in which the column incorporates a number of features facilitating installation and power and communication distribution. Yet another object of the invention is to provide such a system in which partition panels can be quickly and easily mounted to and removed from a column. Yet another object of the invention is to provide a partition panel incorporating a number of features which reduce the overall cost of manufacture yet which provide partition panels which are easy to assemble, install and reconfigure.

Generally, the invention contemplates a space dividing or partitioning system for use in a building having a floor and a ceiling. In accordance with one aspect of the invention, the space dividing system includes a column having a power receptacle arrangement, and at least a pair of partition panels secured to the column at spaced locations on the column. The power receptacle arrangement is accessible from between the pair of partition panels.

In accordance with another aspect of the invention, a space dividing. system includes a column defining an upper end and a lower end adapted to be supported by the floor. The column includes a power receptacle arrangement, and an upper connection arrangement is interconnected with the upper end of the column. The upper connection arrangement is adapted for engagement with the ceiling, and a pair of partition panels are adapted for mounting to the column.

In accordance with yet another aspect of the invention, a column for a space dividing system includes a structural columnar assembly defining an upper end and a lower end for engagement with the floor. A power receptacle arrangement is interconnected with the structural columnar assembly, and includes one or more outwardly facing receptacles. The structural columnar assembly defines a passageway between its upper end and the power receptacle arrangement, for enabling wiring to pass from the ceiling through the passageway and to the power receptacle arrangement. An adjustable height connection arrangement is adapted for interconnection between the upper end of the structural columnar assembly and the ceiling. In this manner, the structural columnar assembly can be engaged with ceilings of different heights, thus enabling the column to be used in different areas of a building.

In accordance with yet another aspect of the invention, a column includes a structural columnar assembly defining an upper end adapted for positioning below the ceiling, and a lower end adapted for engagement with the floor. An adjustable height connection arrangement is adapted for interconnection between the upper end of the structural columnar assembly. One or more luminaires are adapted to be mounted to the column, and each luminaire includes a structural mounting member. The structural columnar assembly includes a luminaire mounting arrangement adjacent its upper end, which is adapted to releasably engage the structural mounting member to removably mount the luminaire to the structural columnar assembly.

In accordance with yet another aspect of the invention, a columnar assembly includes an upper end member, a lower end member, and a series of vertical structural members interconnected with and extending between the upper and lower end members. A series of partition panels are interconnected with the columnar assembly by means of a connection arrangement engaged with each partition panel and with one of the series of vertical structural members, for mounting the partition panels to the columnar assembly.

In accordance with a further object of the invention, a column includes a structural columnar assembly defining an upper end and lower end, and a power receptacle arrangement interconnected with the structural columnar assembly and including one or more outwardly facing receptacles. The structural columnar assembly defines a passageway between the power receptacle arrangement and one of its ends, for supplying wiring to the power receptacle arrangement. At least one cover member is removably engaged with the structural columnar assembly, for selectively providing access to the passageway from the exterior of the structural columnar assembly.

In accordance with a further aspect of the invention, a column includes a structural columnar assembly defining an interior, and a power receptacle arrangement including receptacle mounting structure located within the interior of the structural columnar assembly and interconnected therewith. One or more outwardly facing power receptacles are separate from the receptacle mounting structure and are removably mounted thereto. Wiring is adapted to pass through the interior of the structural columnar assembly for engagement with the one or more outwardly facing power receptacles.

In accordance with a further aspect of the invention, a partition panel includes a frame assembly having one or more inner frame members and defining an opening. A core is received within the opening of the frame assembly, and at least one outer member is engaged with one of the inner frame members. The at least one outer member includes a portion which overlies and engages the core, to maintain the core in position within the opening of the frame assembly.

In accordance with a further aspect of the invention, a partition panel includes a series of inner frame members interconnected together. Each inner frame member defines an inwardly facing surface, which cooperates with the inwardly facing surfaces of the other frame members to define an opening. A core is located within the opening and includes an edge located adjacent each inwardly facing surface. An outer trim member is engaged with each inner frame member, and includes a portion overlying the core to maintain the core in position within the opening.

In accordance with a further aspect of the invention, a partition panel includes a frame assembly having at least one inner frame member. A trim member is adapted for placement over the inner frame member. A retainer member is engaged with the inner frame member, and the trim member and the retainer member include mating engagement structure for mounting the trim member to the inner frame member.

In accordance with a further aspect of the invention, a partition system includes first and second adjacent partition panels. A first upper connector member and a first lower connector member are mounted to the first partition panel. Likewise, a second upper connector member and a second lower connector member are mounted to the second partition panel. An upper pivot connection is interposed between the first and second upper connector members, and a lower pivot connection is interposed between the first and second lower connector members. A synchronizing arrangement is interposed between the first and second upper connector members and between the first and second lower connector members, for providing synchronous pivoting movement of the first and second upper connector members and the first and second lower connector members upon pivoting movement between the first and second partition panels.

In accordance with a further aspect of the invention, a partition panel includes a frame assembly having an upper frame member and defining an opening. A core is received within the opening, and an outer trim member is mounted to the upper frame member. The outer trim member includes an axially extending upwardly facing recess. An auxiliary component is adapted for mounting to the frame assembly, and includes a mounting arrangement for engagement within the recess for mounting the auxiliary component to the partition panel.

In accordance with a further aspect of the invention, a partition system includes a lower partition panel defining an upper edge, and an upper partition panel defining a lower edge. The upper partition panel is located over the lower partition panel such that the lower edge of the upper partition panel is located adjacent the upper edge of the lower partition panel. A connection arrangement is interposed between the lower partition panel and the upper partition panel, and includes a pair of spaced upwardly open passages on the lower partition panel and a pair of spaced downwardly open passages on the upper partition panel. Each downwardly open passage is in alignment with one of the upwardly open passages. A pair of separate connector members are operable to mount the upper partition panel to the lower partition panel. Each connector member includes an upper portion extending into the downwardly open passage, and a lower portion extending into the upwardly open passage. In this manner, the upper panel is removably mounted to the lower panel.

In accordance with a further aspect of the invention, a partition system includes first and second adjacent partition panels, and a pivot connection interposed therebetween for providing pivoting movement about a substantially vertical pivot axis. A vertical alignment arrangement is interposed between the first and second panels. The vertical alignment arrangement includes a substantially horizontal groove provided in the first panel, and a substantially horizontal projection provided on the second panel and received within the groove. The groove and projection are configured to maintain engagement of the projection within the groove upon pivoting movement between the first and second panels. In this manner, the first and second panels are maintained in vertical alignment with each other.

The various aspects of the invention can be employed separately or in subcombinations as desired. In a particularly preferred form, however, all of the various aspects of the invention are incorporated in a space dividing or partitioning system to provide such a system having significant advantages in manufacture, installation and reconfiguration.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 11 is a section view taken along line 11—11 of FIG. 8;

FIG. 13 is a partial elevation view showing the lower end of the column of FIG. 2, with reference to line 13—13 of FIG. 11;

FIG. 14 is a partial section view taken along line 14—14 of FIG. 13;

FIG. 15 is a partial section view taken along line 15—15 of FIG. 13;

FIG. 19 is a partial section view taken along line 19—19 of FIG. 16;

FIG. 20 is a partial section view taken along line 20—20 of FIG. 16;

FIG. 21 is a partial section view taken along line 21—21 of FIG. 16;

FIG. 22 is a partial section view taken along line 22—22 of FIG. 21;

FIG. 23 is a partial section view taken along line 23—23 of FIG. 21;

FIG. 25 is a view similar to FIG. 24, showing the components in an assembled condition;

FIG. 26 is a partial section view taken along line 26—26 of FIG. 25;

FIG. 27 is a partial section view taken along line 27—27 of FIG. 25;

FIG. 35 is a partial elevation view showing adjacent corners of partition panels as in FIG. 16 and a pivot connection arrangement for interconnecting the panel ends;

FIG. 36 is an exploded elevation view showing the components of the pivot connection arrangement of FIG. 35;

FIG. 39 is a partial elevation view of a stacked pair of partition panels as in FIG. 16 and illustrating a connector for securing the stacked panels together;

FIG. 40 is an isometric view of the connector for stacking partition panels as in FIG. 39;

FIG. 41 is a partial section view similar to FIG. 19 illustrating engagement of an auxiliary component with a partition panel;

FIG. 42 is a partial isometric view similar to FIG. 32, showing a post for placement at a right angle corner between adjacent partition panels and a connector for interconnecting the panel ends with the post;

FIG. 43 is a partial section view taken along line 43—43 of FIG. 42;

FIG. 44 is a view similar to FIG. 23 illustrating a pivot connection between adjacent panel ends and an arrangement for maintaining the panel ends in vertical alignment with each other; and FIG. 45 is a partial section view taken along line 45—45 of FIG. 44.

DETAILED DESCRIPTION OF THE INVENTION

Figure 1:
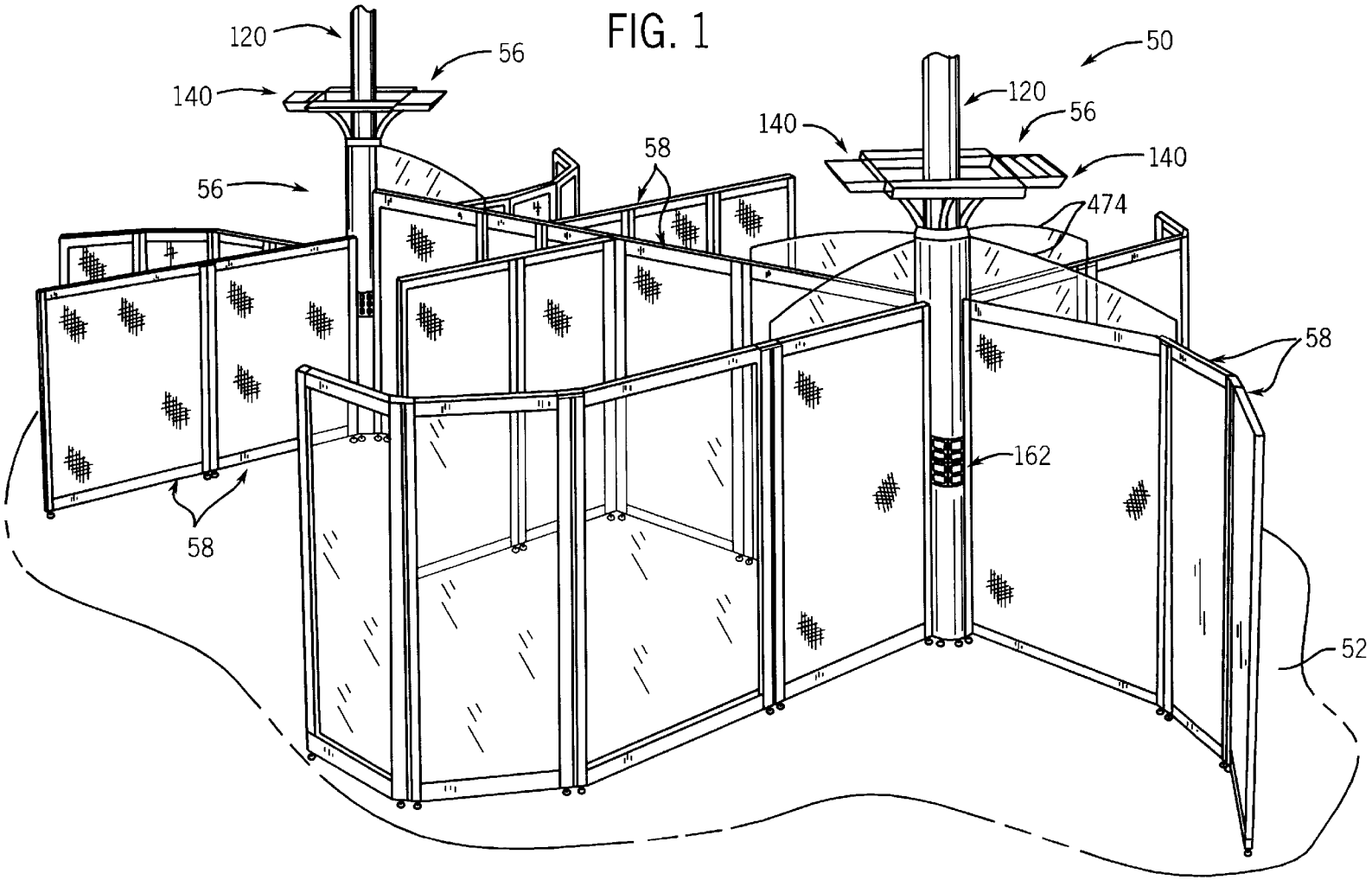
FIG. 1 is an isometric view illustrating a space dividing or partitioning system in accordance with the present invention.

FIG. 1 illustrates a space dividing or partitioning system 50 constructed in accordance with the present invention. Space dividing system 50 is adapted for use in a building having a floor 52 and a ceiling 54 (FIG. 2), and is operable to divide a larger space into smaller areas. In particular, space dividing system 50 is adapted for use in a workplace environment to divide the space into individual work areas, meeting areas, reception areas or the like. Generally, space dividing system 50 includes a series of columns shown generally at 56, and a series of partition panels shown generally at 58.

FIGS. 2–15 illustrate the construction of column 56. Referring to FIG. 3, column 56 includes a structural columnar frame assembly 60 including an upper end plate 62 and a lower end plate 64. A series of vertical rods 66 extend between and interconnect upper end plate 62 and lower end plate 64. Each rod 66 defines an upper end received within an opening formed in upper end plate 62, and is mounted thereto such as by welding. Similarly, each rod 66 defines a lower end received within an opening formed in lower end plate 64, and is mounted thereto such as by welding. In this manner, upper end plate 62, lower end plate 64 and rods 66 make up the structural skeleton of column 56.

Upper end plate 62 defines a central opening 68 and a series of spaced openings 70 located between central opening 68 and the outer edge of upper end plate 62. As shown in FIGS. 3 and 4, a central sleeve 72 is mounted at its upper end to the underside of upper end plate 62 such as by welding, and defines a passage 74 in alignment with central opening 68 formed in upper end plate 62. Similarly, a series of outer sleeves 76 are mounted to upper end plate 62. Each sleeve 76 is received within a cut-out 78 formed in the outer edge of one of openings 70. Each sleeve 76 defines an upwardly open internal passage 80 which is accessible from above the upper surface of upper end plate 62. Vertically spaced thumb screws 82 are threadedly engaged within vertically spaced threaded openings formed in central sleeve 72 and each of outer sleeves 76.

An upper mounting rod 84 is telescopingly received within passage 74 defined by central sleeve 72. Upper mounting rod 84 extends upwardly from upper end plate 62, and the length of upper mounting rod 84 disposed above upper end plate 62 can be adjusted by use of thumb screws 82 in a manner as is known. An upper mounting plate 86 is secured to the top of upper mounting rod 84 such as by welding. Upper mounting plate 86 includes an opening adjacent each end, which is adapted to receive the threaded stud 88 of a clip member 90. In a manner as is known, clip member 90 includes an inwardly directed tab, located on each of its sides. Each tab is adapted to overlie the lower flange, shown at 92, of a structural ceiling member 94. In a manner as is known, ceiling member 94 spans between a pair of ceiling frame members 96, and is interconnected at each end with one of ceiling frame members 96. With this arrangement, column 56 can be mounted at any position relative to ceiling 54, and the user simply forms an opening 98 in a ceiling tile 100 to enable the upper end of upper mounting rod 84 to pass through ceiling 54. Alternatively, if column 56 is positioned directly in line with one of ceiling frame members 96, clip members 90 are engaged with the lower flange defined by ceiling frame member 96. Once clip members 90 are engaged with flange 92 of ceiling member 94 or with the lower flange of one of ceiling member 96, the user tightens stud 88 so as to clamp clip member 90 in position. A nut 102 is then engaged with stud 88 to fix upper mounting plate 86 to ceiling member 94 or ceiling frame member 96, to thereby provide stability to the upper end of column 56.

Referring to FIGS. 3 and 4, an upper ring member 104 is mounted to upper end plate 62. Upper ring member 104 includes a top wall 106 and a depending side wall 108. A series of mounting bosses 110 depend from the underside of top wall 106, and each mounting boss 110 defines a downwardly facing passage. Openings 112 are formed in upper end plate 62, and each mounting boss passage is positioned in alignment with one of openings 112. A threaded fastener 114 extends through each opening 112 and into the aligned mounting boss passage, for securing upper ring member 104 to upper end plate 62.

Figure 5:
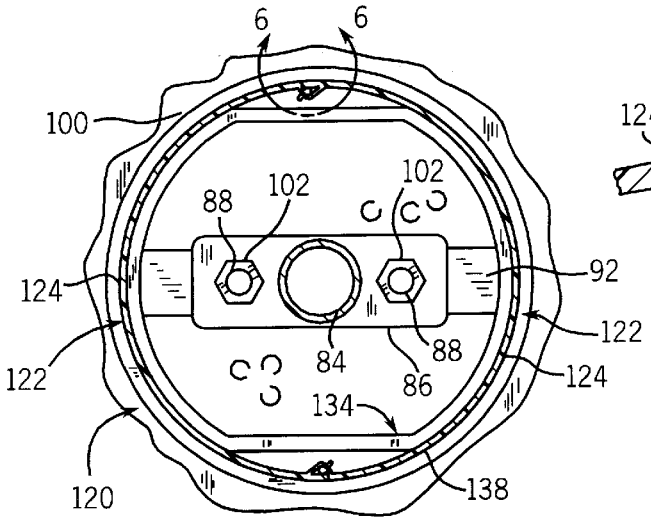
FIG. 5 is a section on view taken along line 5—5 of FIG. 4.
Figure 6:
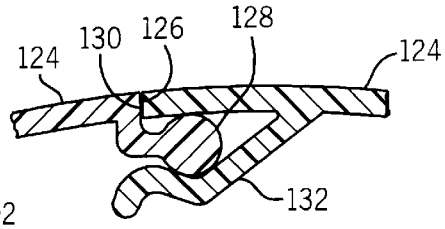
FIG. 6 is a partial enlarged view with reference to line 6—6 of FIG. 5.

Top wall 106 of upper ring member 104 includes a lip 116 defining a central opening 118. A cover assembly 120 is adapted to extend between upper ring member 104 and ceiling tile 100 so as to conceal upper mounting rod 84 and wiring from above ceiling 54. Referring to FIGS. 5 and 6, cover assembly 120 includes a pair of identical cover half sections 122. Each half section 122 includes a wall 124 which is semicircular in cross-section. At one end, wall 124 defines a shoulder 126 and a bead 128 extending therefrom. At its other end, wall 124 terminates in an end edge 130, and a snap arm 132 extends inwardly from the inner surface of wall 124 adjacent end edge 130. As shown in FIG. 6, snap arm 132 is configured to deflect inwardly so as to receive bead 128 between snap arm 132 and the inner surface of wall 124 adjacent end edge 130, so as to releasably secure cover assembly half sections 122 together using a push-together force. When cover assembly half sections 122 are engaged with each other as shown in FIG. 6, end edge 130 is located adjacent shoulder 126 so as to provide a substantially continuous outer surface for cover assembly 120. Cover assembly half sections 122 can be pulled apart by exerting a pull-apart force, which removes bead 128 from between snap arm 132 and the inner surface of wall 124. In this manner, cover assembly 120 can be assembled about upper mounting rod 84 and cables or wiring extending between ceiling 54 and column 56.

Lip 116 of upper ring member 104 engages the lower end of cover assembly 120 so as to support cover assembly 120 thereabove. At the upper end of cover assembly 120, a ring 134 is positioned between the lower surface of ceiling tile 100 and the facing upper ends of cover assembly half sections 122. Ring 134 includes a side wall 136 having a shape corresponding to the internal configuration of cover assembly half sections 122 when secured together, and an upper flange 138 extending outwardly from the upper end of side wall 136. Upper flange 138 is positioned between ceiling 100 and the upper ends of cover assembly half sections 122. In use, the user forms opening 98 in ceiling tile 100 so as to be smaller than the outer diameter defined by flange 138, such that flange 138 completely conceals opening 98 when cover assembly 120 is assembled.

In use, cover assembly half sections 122 are supplied in a single length which is sufficient to span a distance between the upper end of column 56 and a ceiling 54 of maximum height. At installation, the user measures the distance between the downwardly facing surface of ceiling tile 100 and the upwardly facing surface of lip 116, and cuts cover assembly half. sections 122 to length while accommodating for the space required for flange 138. Preferably, cover assembly half sections 122 are formed of an extruded plastic material which is relatively easy to cut using a conventional cutting tool such as a saw.

Figure 2:
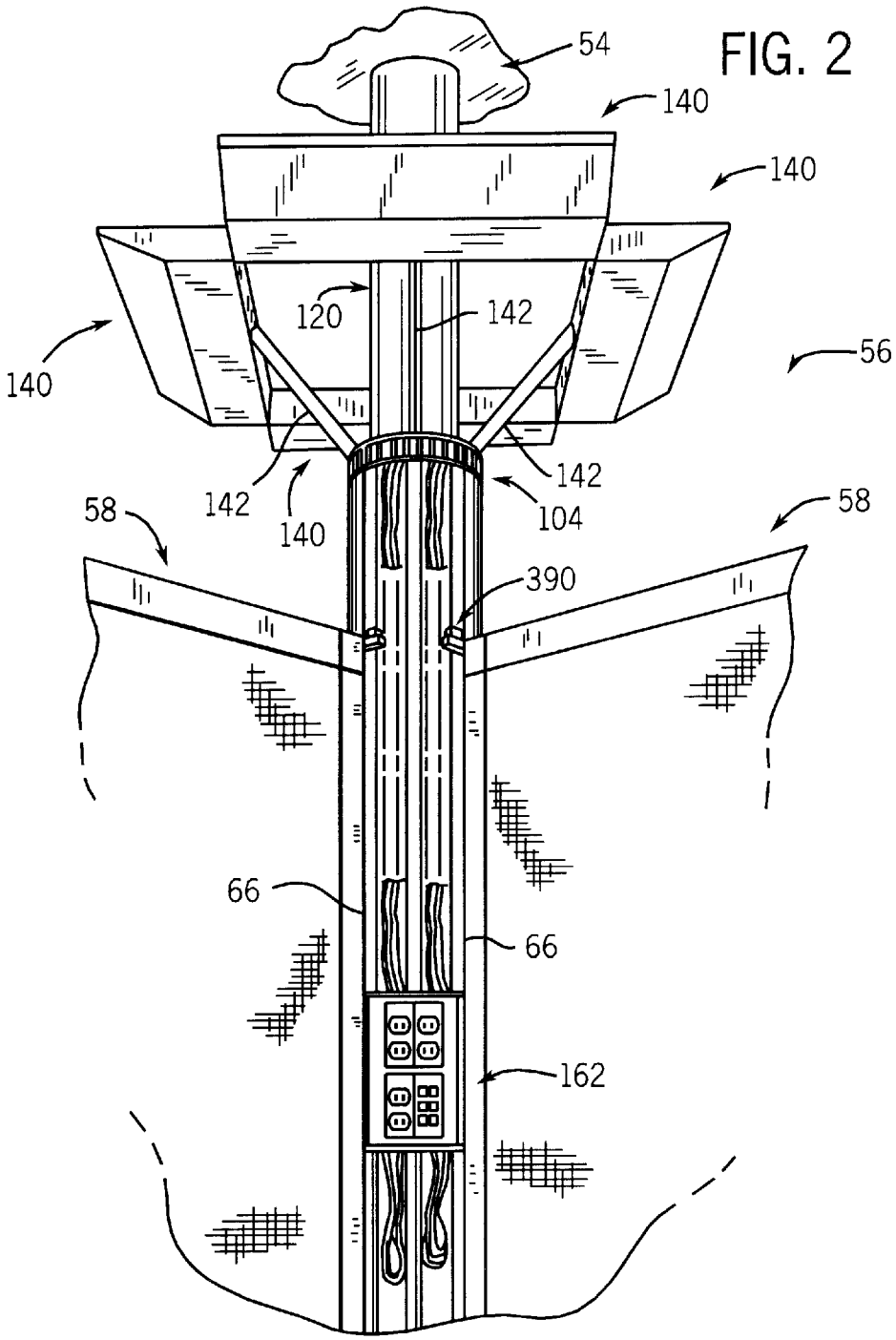
FIG. 2 is a partial isometric view illustrating the upper end of a column for use in the space partitioning system of FIG. 1.
Figure 3:
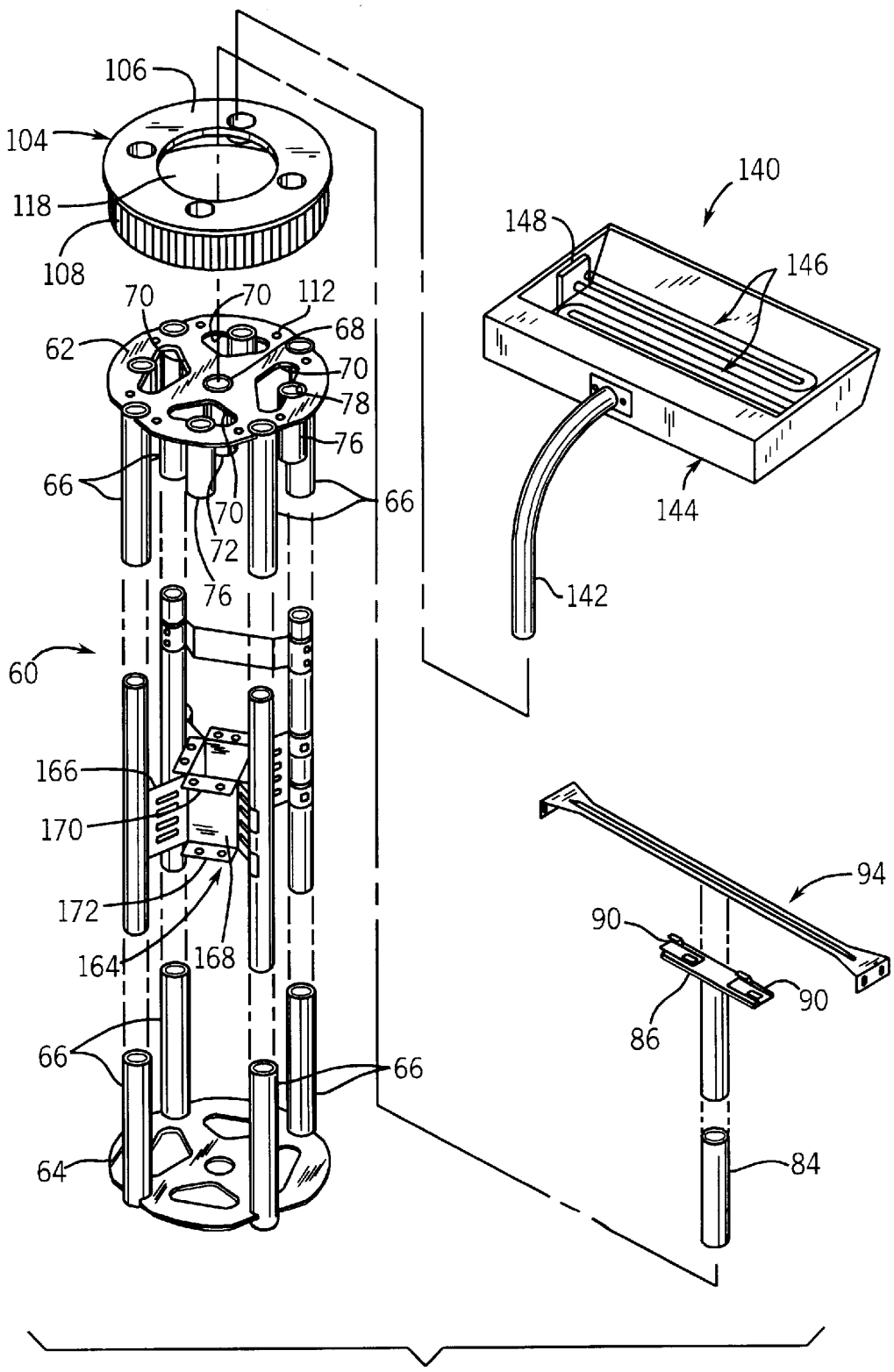
FIG. 3 is an exploded isometric view showing components of the column of FIG. 2.
Figure 4:
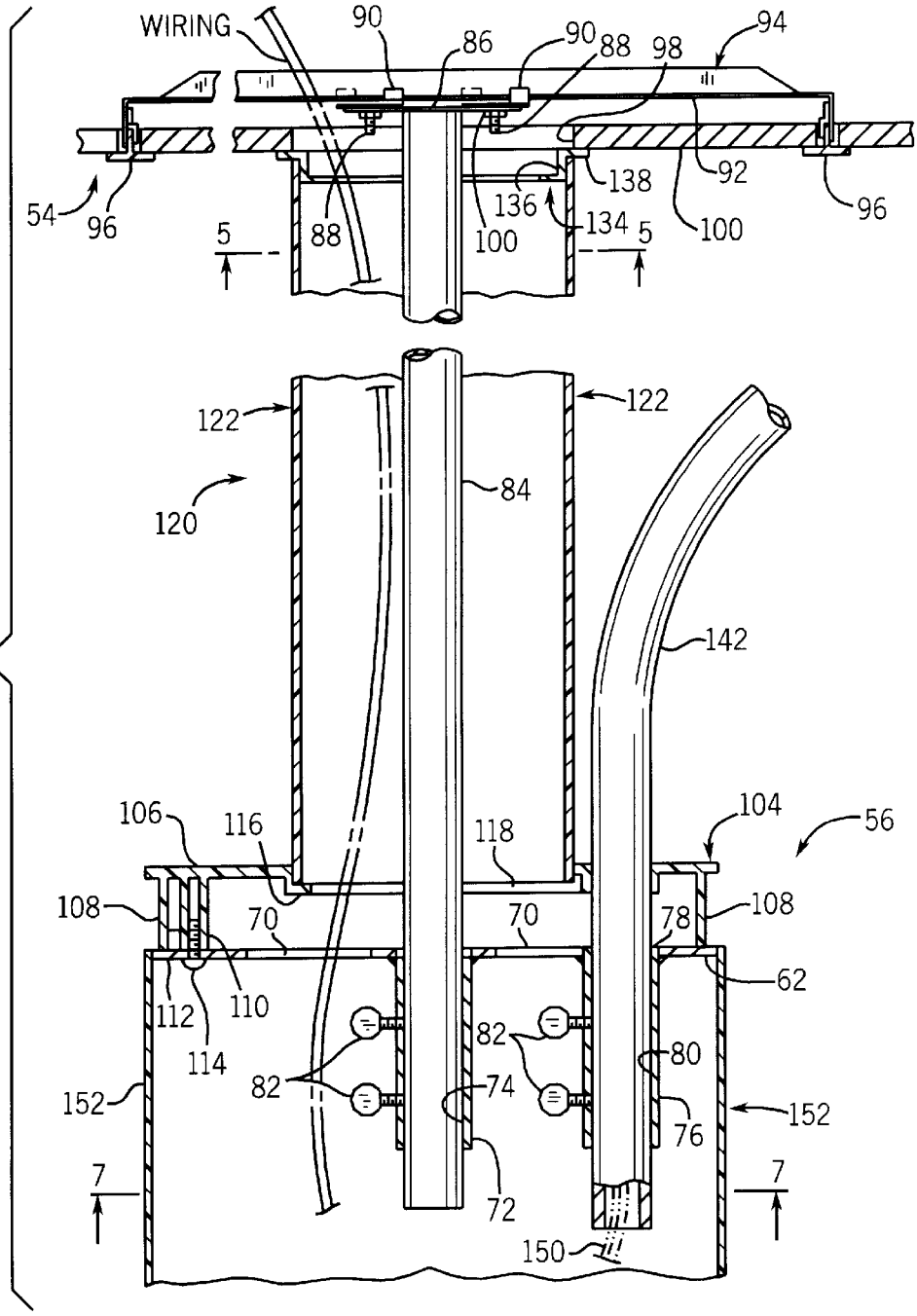
FIG. 4 is a longitudinal section view of the upper end of the column of FIGS. 2 and 3 showing interconnection of the column with a ceiling.

Referring to FIGS. 2–4, column 56 is adapted to support a series of light assemblies or luminaires 140 which provide indirect illumination to the area adjacent column 56. Each luminaire 140 includes a tubular mounting arm 142 and a pan 144 connected to the upper end of arm 142. Pan 144 has an open top and a closed bottom, and carries a pair of lamps 146 mounted to a pair of sockets, such as shown at 148. Appropriate wiring is interconnected with pan 144 so as to supply power to sockets 148, and the wiring extends through tubular arm 142. As shown in FIG. 4, the lower end of each arm 142 is received within passage 80 defined by one of outer sleeves 76, and thumb screws 82 are employed to fix the vertical and rotational position of each luminaire 140 relative to column 56. The wiring which extends through the internal passage defined by mounting arm 142 is shown in FIG. 4 at 150, extending from the lower end of arm 142 into the interior of column 56.

Figure 7:
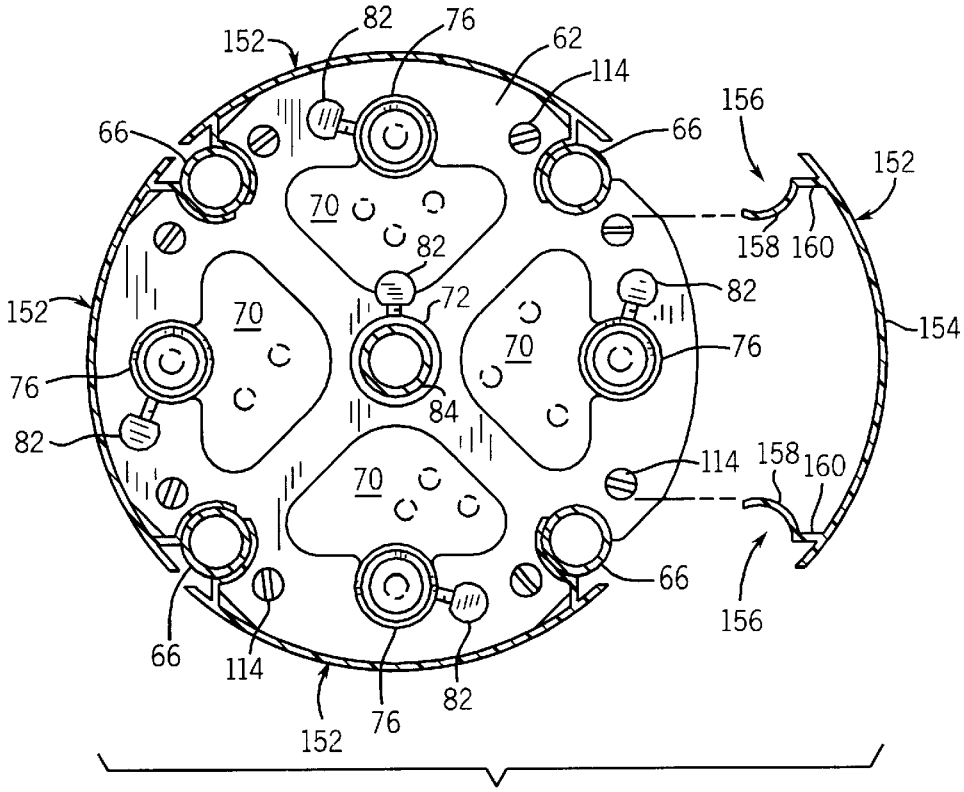
FIG. 7 is a section view taken along line 7—7 of FIG. 4.

Referring to FIG. 7, a series of column covers 152 are adapted for engagement with vertical rods 66 for enclosing the interior of column 56. Each column cover 152 includes an arcuate outer wall 154 terminating in a pair of spaced ends, with a retainer member 156 located adjacent each end. Each retainer member 156 extends inwardly from the inner surface of outer wall 154, and includes an arcuate inner end 158 and a connector section 160 extending between the inner surface of outer wall 154 and arcuate inner end 158. Arcuate inner ends 158 face in opposite directions.

Column covers 152 are preferably formed of an extruded flexible plastic material, providing sufficient resiliency or flex to enable arcuate inner ends 158 to snap into engagement with adjacent facing surfaces of vertical rods 66. In this manner, column covers 152 conceal structural columnar frame assembly 60 as well as the interior of column 56. As shown in FIG. 7, the ends of adjacent column covers 152 are spaced slightly apart from each other, which exposes the outwardly facing surface of each vertical rod 66. Preferably, vertical rods 66 have the same color as column covers 152, which thus provides depth and aesthetic interest to column 56. In addition, the space between the ends of adjacent column covers 152 accommodates engagement of partition panels 58 with column 56, in a manner which will later be explained. Further, the spaces between the ends of adjacent column covers 152 enable a user to grasp the ends of one of column covers 152, such that column cover 152 can be disengaged from vertical rods 66 by exerting a pull-off force on column cover 152 to disengage arcuate inner ends 158 from vertical rods 66 to gain access to the interior of column 56.

Figure 8:
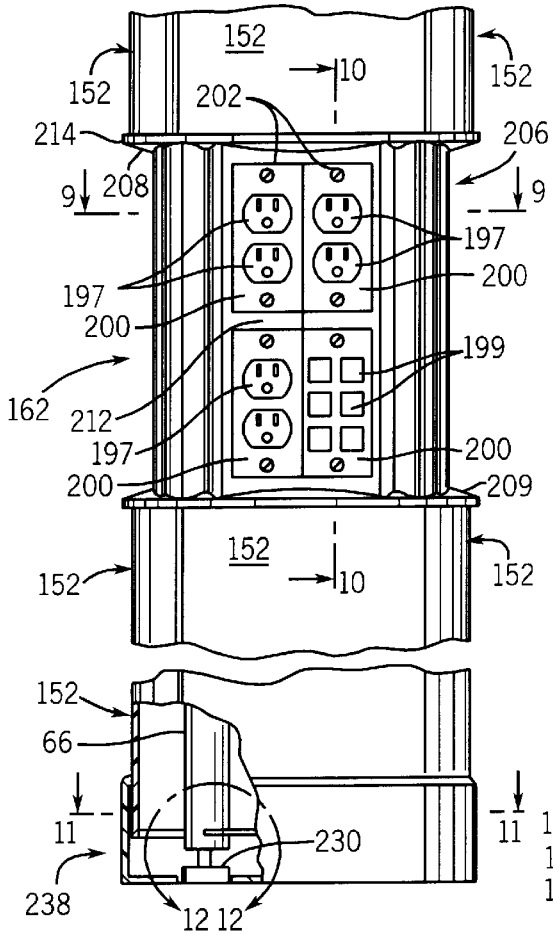
FIG. 8 is a partial elevation view of the column of FIG. 2 showing the receptacle arrangement.
Figure 9:
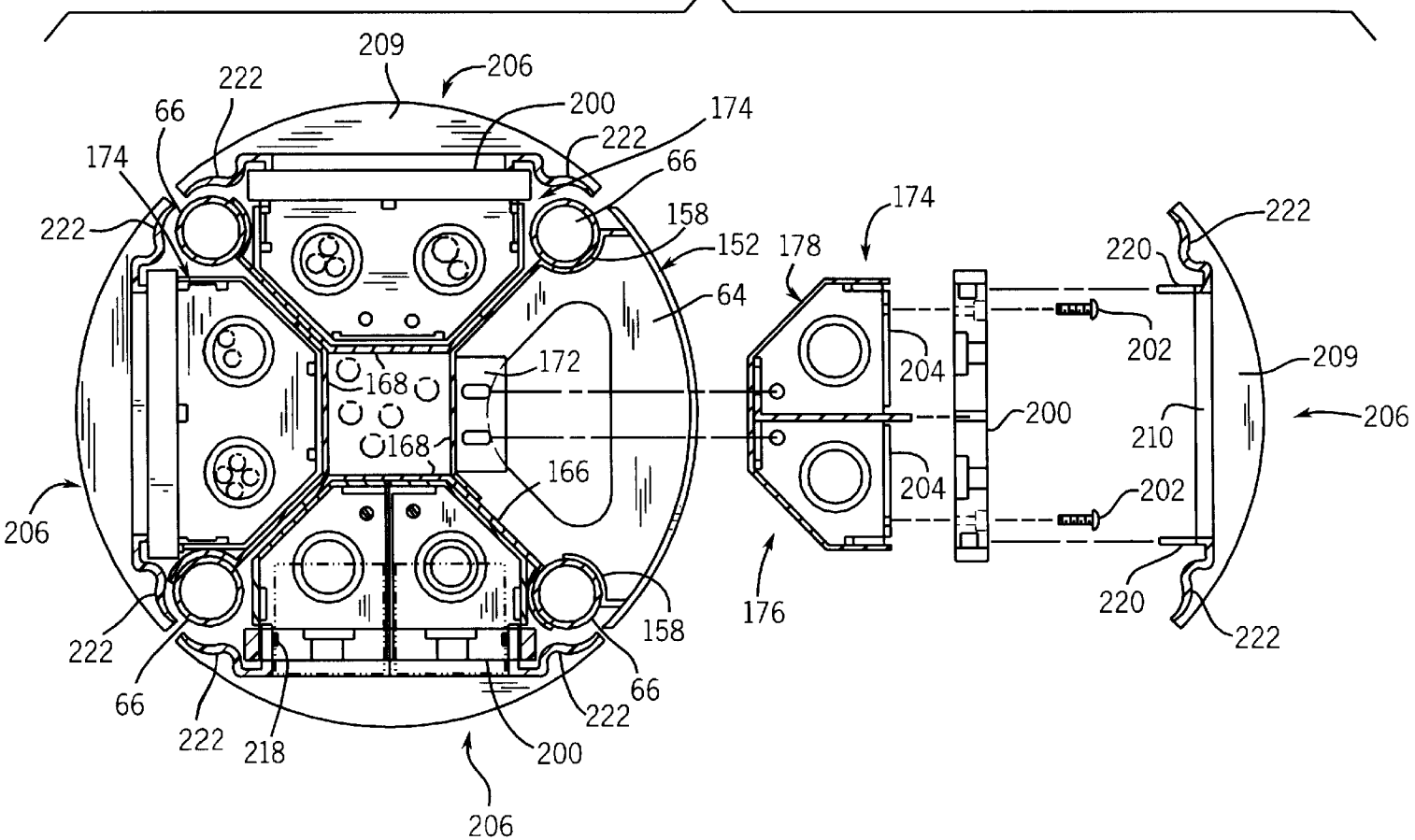
FIG. 9 is a section view taken along line 9—9 of FIG. 8.

Referring to FIG. 8, column 56 includes a receptacle arrangement, shown generally at 162. Receptacle arrangement 162 is located at approximately desk height. As shown in FIGS. 3 and 9, receptacle arrangement 162 is supported by a receptacle bracket assembly 164 mounted to vertical rods 66. Receptacle bracket assembly 164 includes a series of arms 166, each of which is mounted at its outer end to one of vertical rods 66. Arms 166. support a central box defined by a series of panels 168, such that arms 166 function to fix panels 168 within the interior of column 56. Upper and lower flanges 170, 172, respectively, extend outwardly from the upper and lower ends, respectively, of each panel 168.

Figure 10:
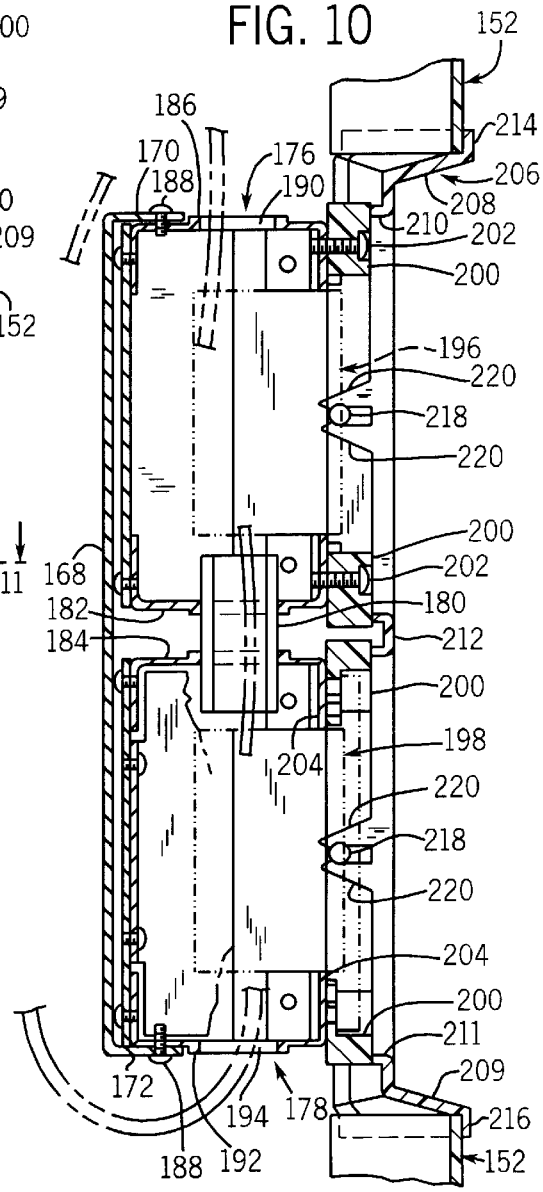
FIG. 10 is a partial section view taken along line 10—10 of FIG. 8.

Referring to FIGS. 8–10, a receptacle box assembly 174 is releasably engageable with each set of upper and lower flanges 170, 172. Each receptacle box assembly 174 includes an upper pair of boxes 176 and a lower pair of boxes 178. Each upper box 176 is connected to one of lower boxes 178 via a nipple 180 mounted to a lower wall 182 defined by each upper box 176 and to an upper wall 184 defined by each lower box 178. Each upper box 176 further includes an upper wall 186, which is mounted to upper flange 170 via a threaded fastener 188. Upper wall 186 of each upper box 176 further includes an opening 190. Similarly, each lower box 178 defines a lower wall 192 engaged with lower flange 172 via a threaded fastener 188, and an opening 194 is formed in lower wall 192 of each lower box 178.

A power receptacle module 196 is mounted to each upper box 176, and each power receptacle module 196 provides two power outlets 197. Similarly, a power receptacle module 196 having a pair of power outlets 197 is mounted to one of power boxes 178. A communication receptacle module 198 is mounted to the other of lower boxes 178, and communication receptacle module 198 includes a series of voice communication receptacles and data communication receptacles, shown at 199.

A face plate 200 is mounted over each power receptacle module 196 and communication receptacle module 198. Each face plate 200 defines openings providing access to power outlets 198 and voice or data receptacles 199. Each face plate 200 is connected to its respective box 176 or 178, by means of upper and lower threaded fasteners 202 extending through openings formed in face plate 200 in alignment with openings formed in a front wall, such as shown at 204, associated with each box such as 176, 178.

A bezel member 206 surrounds face plates 200. Bezel member 206 defines an angled upper end wall 208 and an angled lower end wall 209, as well as rectangular inner lips 210, 211 which engage the outer surfaces of face plates 200 and defining openings through which outlets 197 and receptacles 199 are exposed. A central transverse divider 212 extends across bezel member 206 between lips 210 and 211. Bezel member 206 further includes an upwardly extending lip 214 extending upwardly from the upper end of upper end wall 208, and a depending vertical lip 216 extending downwardly from the lower end of lower end wall 209. Upwardly extending lip 214 receives and supports the lower end of a column cover 152, whereas depending lip 216 receives and overlies the upper end of a column cover 152.

Each face plate 200 includes a peg 218, and bezel member 206 includes spaced pairs of engagement arms 220 adapted to snap onto and engage pegs 218. In this manner, bezel member 206 is engaged with face plates 200 using a push-on force and is disengaged using a pull-off force, without the need for tools, to provide ease of assembly and disassembly.

Referring to FIG. 9, each bezel member 206 includes a pair of outwardly extending wings 222 which are operable to conceal vertical rods 66 when bezel member 206 is in position on column 56. Each wing 222 terminates in line with the edges of column covers 152 above and below bezel member 206, to provide continuity in the outward appearance of column 56.

Referring to FIGS. 2, 4 and 10, wiring is supplied from above ceiling 54 through cover assembly 120 and into the interior of column 56. The wiring may be in the form of flexible power cables interconnected with the power receptacles such as 196 and flexible voice and/or data communication cables interconnected with communication receptacle module 198. Alternatively, module 196 and 198 may be prewired, with the wiring extending through a flexible conduit terminating in a connector, such as supplied by Pent Electric under its designation UL1286. In this manner, a power infeed terminating in a mating receptacle can be fed downwardly from above ceiling 54 and through the passage of column 56, for connection to the connector to which power receptacle module 196 are prewired. Similarly, communication receptacle modules 198 may be prewired with a connector to facilitate engagement of a mating connector therewith within the interior of column 56.

While wiring has been shown and described as feeding downwardly from above ceiling 54 and into the interior of column 56, it is also understood that wiring could be fed from the lower end of column 56 into the column interior for interconnection with modules 196 and 198 below receptacle arrangement 162.

Figure 12:
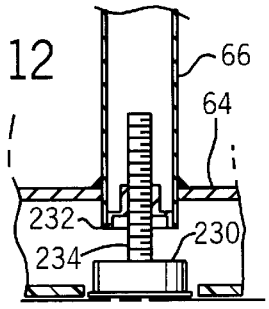
FIG. 12 is an enlarged partial section view taken along line 12—12 of FIG. 8.

Referring to FIGS. 8 and 12, a foot 230 is engageable with the lower end of each vertical rod 66. A threaded member 232 is mounted to the lower end of each rod 66, and a threaded shaft 234 is engaged with each foot 230 and threadedly engaged with each threaded member 232. With this arrangement, the position of each foot 230 relative to the lower end of each vertical rod 66 can be adjusted, to plumb column 56.

As shown in FIGS. 11–15, a base cover assembly 238 is provided at the lower end of each column 56. Base cover assembly 238 is assembled after column covers 152 are engaged with vertical rods 66, and functions to finish the lower end of column 56. Base cover assembly 238 is made up of four identical interlocking base cover sections 240, each of which includes a side wall 242 having an inwardly tapered upper edge 244. At one end, each base cover section 240 defines an inwardly angled end wall 246 and an end extension 248 having an outward rib 250. At its other end, each base cover section 240 includes an angled end edge 252, from which a pair of tabs 254 extend outwardly. An inwardly extending detent 256 is located adjacent each end edge 252.

To assemble base cover sections 240 about the lower end of column 56, adjacent base cover sections 240 are first placed at an angle relative to each other and then pivoted about a fulcrum defined by engagement of the end of side walls 242 with the outwardly facing surfaces of tabs 254. The base cover sections 240 are then pivoted to the position as shown in FIGS. 14 and 15, to bring rib 250 into engagement with the mating surface defined by detent 256, so that adjacent base cover sections 240 are prevented from being axially pulled apart. When the last base cover section 240 is to be engaged, the user brings the base cover sections together using a push-together force, aligning tabs 254 behind the inner surface of side wall 242. With continued relative push-together movement between adjacent base cover sections 240, rib 250 engages detent 256 and end extension 248 deflects inwardly until rib 250 clears detent 256, at which time the mating surfaces defined by rib 250 and detent 256 are in engagement with each other as shown in FIG. 15. This functions to hold base cover sections 240 together about the lower end of column 56. Base cover sections 240 can be disassembled by reversing the above steps.

Figure 16:
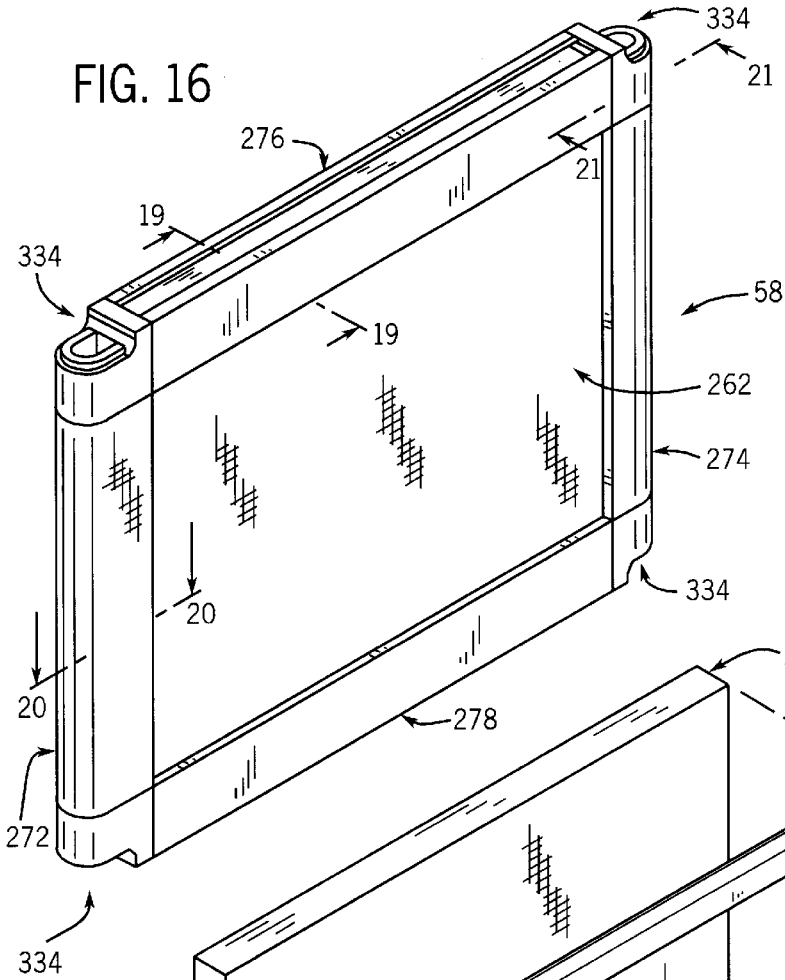
FIG. 16 is an isometric view of a partition panel incorporated in the space dividing system of FIG. 1.
Figure 18:
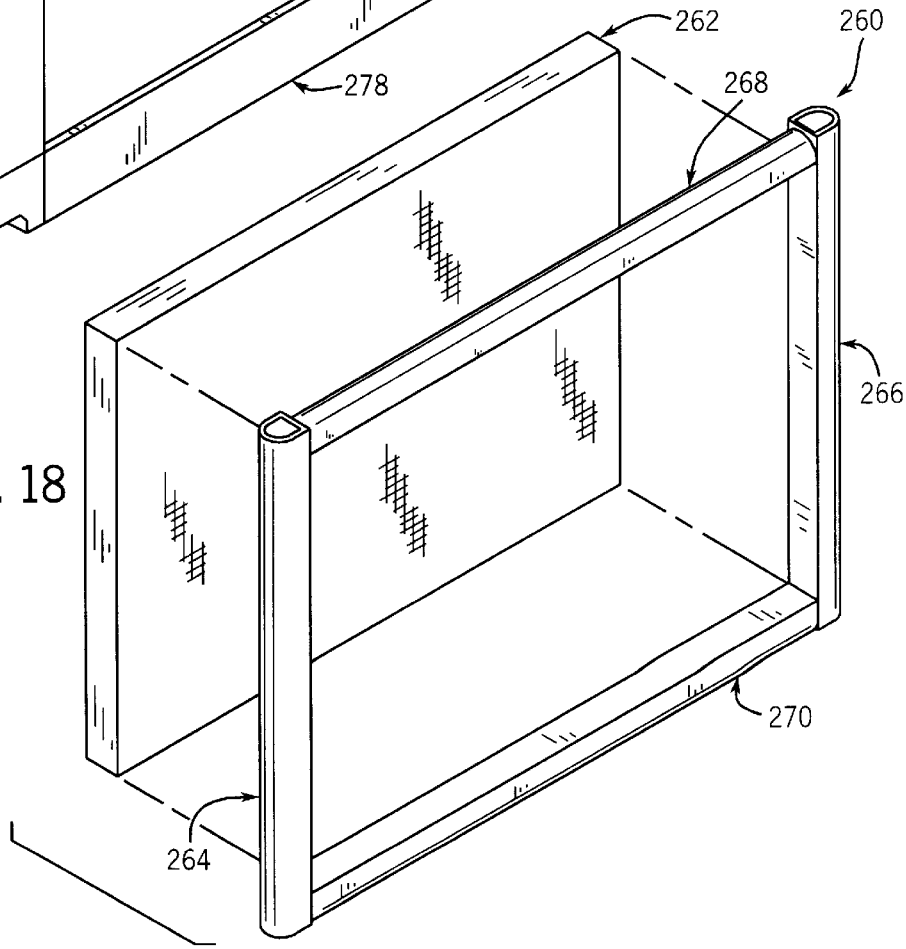
FIG. 18 is an exploded isometric view showing the frame assembly and the core of the partition panel of FIGS. 16 and 17.
Figure 17:
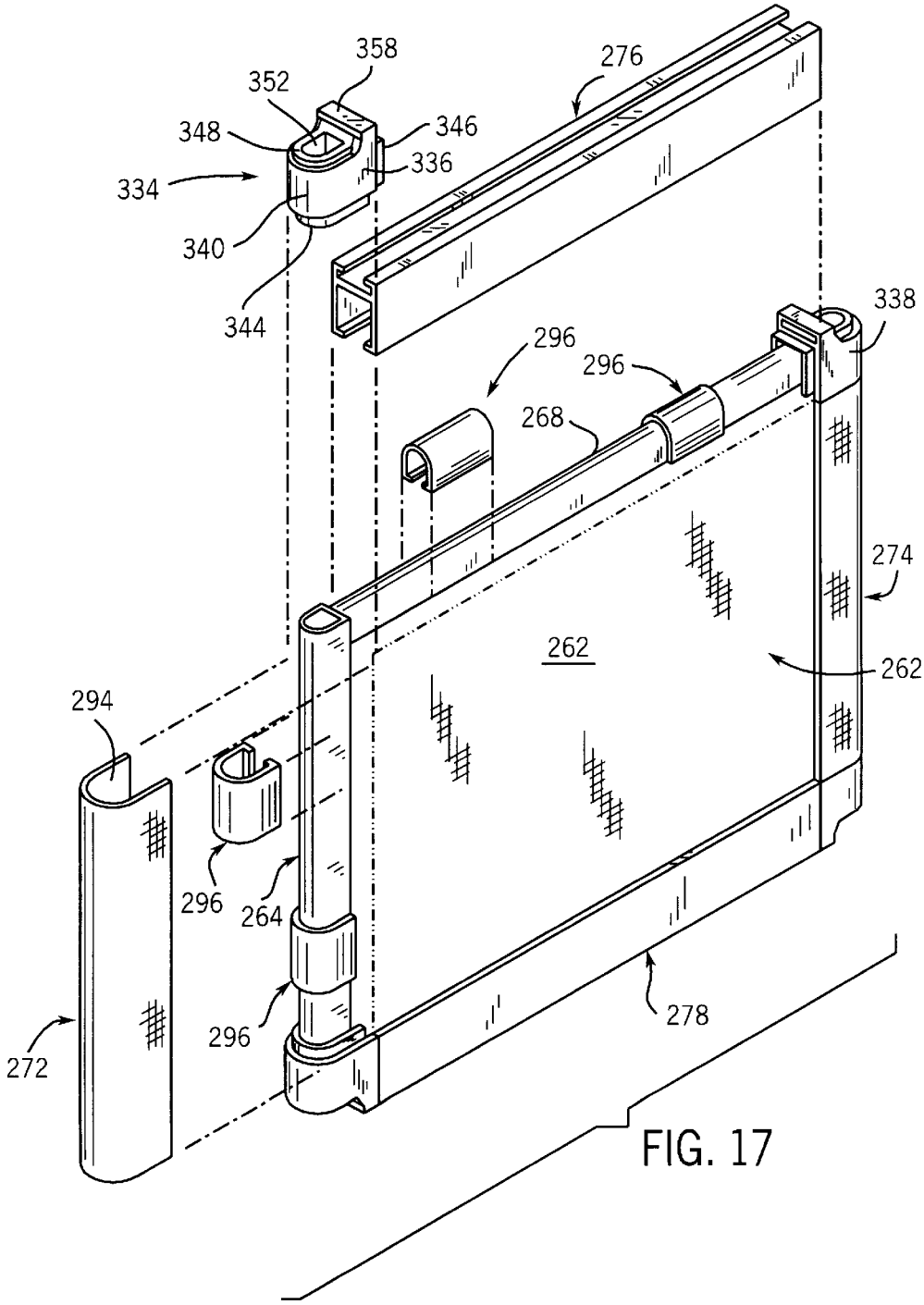
FIG. 17 is an exploded isometric view of the partition panel of FIG. 16.

FIGS. 16–20 illustrate the construction of partition panels 58 for use in space dividing system 50. Referring to FIGS. 16–18, each partition panel 58 includes a frame subassembly, shown generally at 260, in combination with a core 262. Frame subassembly 260 is preferably formed of a pair of side frame members 264, 266, a top frame member 268 and a bottom frame member 270. Frame members 264–270 are preferably identically constructed of a metallic material such as steel having a D-shaped cross-section, although it is understood that any other material or cross-section could be employed as desired. With this construction, each of frame members 264–270 defines a flat inwardly facing surface, so as to form an opening within which core 262 is received. Core 262 is sized so as to fit closely within the opening defined by frame members 264–270, with an edge of core 262 being located closely adjacent the inwardly facing surface defined by each of frame members 264–270.

The ends of top frame member 268 are welded to the facing surfaces of side frame members 264, 266 at the upper end of each of side frame members 264, 266. Similarly, the ends of bottom frame member 270 are welded to the facing surfaces of side frame members 264, 266 at the lower end of each of side frame members 264, 266, so as to rigidly interconnect frame members 264–270 to form rectangular frame subassembly 260. With the cross-section of frame members 264–270 as shown and described, each of frame members 264–270 defines a curved outwardly facing wall facing away from the inner surface of each frame member defining the opening in frame subassembly 260.

Referring to FIGS. 16, 17, 19 and 20, partition panel 58 further includes a pair of side trim or cover members 272, 274 as well as a top trim or cover member 276 and a bottom trim or cover member 278. Side cover members 272, 274 are substantially identical in construction, as are top and bottom cover members 276, 278.

Referring to FIG. 20, side cover member 272 includes a U-shaped base member 280 defining spaced legs 282, 284, with an arcuate end 286 extending between and interconnecting legs 282, 284. Base member 280 is preferably formed of an extruded material such as plastic, which provides resiliency enabling legs 282, 284 to flex away from each other and to thereafter return to their undeformed condition such as shown in FIG. 20. A layer of fabric 288 is bonded to the outer surface of base member 280 in any satisfactory manner, such as by an adhesive or the like. Fabric 288 includes end portions 290, 292 which wrap about the ends of legs 282, 284, respectively and which are adhered to the inner surfaces of legs 282, 284 toward the ends thereof, for concealing the ends of walls 282, 284.

A series of spaced, longitudinal grooves 294, 295 are formed in the facing inner surfaces of base member walls 282, 284, respectively.

A series of retainer clip members 296 are engaged with side frame member 264 at intervals along the length of side frame member 264. Retainer clip members 296 are extruded to define a cross-section similar to that of side frame member 264. Referring to FIG. 20, each side clip member 296 includes a pair of legs 298, 300 interconnected by an arcuate section 302. A lip 304 extends inwardly from the outer end of leg 298, and a lip 306 extends inwardly from the end of leg 300. A series of teeth or serrations 308 are formed on the outer surface of leg 298. Similarly, a series of spaced teeth or serrations 310 are formed on the outer surface of leg 300.

Retainer clip members 296 are preferably formed of an extruded resilient, relatively rigid but flexible plastic material, although it is understood that any other satisfactory material could be used. Each clip member 296 is engaged with side frame member 264 by applying a push-on force to retainer clip member 296 toward side frame member 264. The ends of lips 304, 306 contact the arcuate outer surface of side frame member 264 to spread legs 298, 300 apart, and application of the push-on force is continued until lips 304, 306 snap over the flat inner surface of side frame member 264 to assume the position of FIG. 20. The resiliency of the plastic material from which retainer clip member 296 is constructed enables retainer clip member 296 to deform from its original condition and to thereafter return to its original condition when in the position of FIG. 20 to securely engage side frame member 264. As can be seen, retainer clip member 296 is shaped so as to closely conform to the outer contours of side frame member 264, so that lips 304, 306 securely maintain retainer clip member 296 in its FIG. 20 position relative to side frame member 264. An adhesive or other bonding agent may be interposed between the inner surface of retainer clip member 296 and the facing outer surfaces of side frame member 264 to maintain retainer clip member 296 in a desired position on side frame member 264. As shown in FIG. 17, a pair of retainer clip members 296 are mounted to side frame member 264 at spaced locations along the length of side frame member 264, although it is understood that any number of retainer clip members 296 may be employed.

With retainer clip members 296 mounted to side frame member 264, side cover member 272 is engaged with side frame member 264 by exerting a push-on force on side cover member 272 toward side frame member 264. Legs 282, 284 of side cover member 272 are formed so as to converge toward each other. This construction results in legs 282, 284 spreading apart as side cover member 272 is pushed onto side frame member 264, and this push-on force is continued until side cover member 272 attains its position of FIG. 20. In this position, serrations 308, 310 of retainer clip member 296 are received within grooves 294, 295 of sidecover member walls 282, 284, respectively, and serrations 308, 310 and grooves 294, 295 are formed so as to maintain engagement of side cover member 272 with retainer clip members 296 against application of an outward pull-off force. Side cover member legs 282, 284 have a length sufficient to overlie core 262 adjacent the inwardly facing flat surface of side frame member 264. With this construction, the portions of side cover member legs 282, 284 which overlie core 262 function to retain core 262 within the opening defined by frame subassembly 260. Side cover member is removable from side frame member by manually grasping the ends of side cover member legs 282, 284 and pulling them apart, to disengage serrations 310 from grooves 294. The user then exerts an outward pull-off force on cover member 272, to remove cover member 272 from side frame member 264.

A series of retainer clip members 296 are also engaged with side frame member 266 in the same manner as described with respect to side frame member 264, and side cover member 274 is engaged with and removable from side frame member 266 in the same manner as described above with respect to side cover member 272. Side cover member 274 is constructed identically to side cover member 272, and includes spaced legs having inner portions which overlie core 262 adjacent side frame member 274 to maintain core 262 in position adjacent side frame member 266.

Referring to FIG. 19, top cover member 276 includes a pair of side walls 312, 314 which are interconnected via an upper web 316. Inwardly extending lips 318, 320 are provided at the lower ends of side walls 312, 314, respectively. Side wall 312 includes a series of grooves 322 formed in its inner surface, and a series of grooves 324 are formed in the inner surface of side wall 314.

In the same manner as set forth with respect to side frame member 264, a series of retainer clip members 296 are engaged with top frame member 268. Top cover member 276 is engaged with top frame member 268 in the same manner as described previously with respect to side cover member 272 and side frame member 264, by application of a push-on force toward top frame member 268. Top cover member 276 is preferably formed of an extruded plastic material, which enables side walls 312, 314 to flex outwardly upon engagement of the inner ends of lips 318, 320 with arcuate section 302 of retainer clip member 296. Application of the push-on force to top cover member 276 is continued until top cover member 276 attains its FIG. 19 position, in which side walls 312, 314 return to their undeformed condition in which serrations 308, 310 of retainer clip member 296 are engaged within grooves 322, 324, respectively. In this position, the underside of web 316 engages the outer surface of top frame member 268 as shown in FIG. 19, in which end portions of side walls 312, 314 overlie core 262 adjacent the inwardly facing flat surface of top frame member 268. In this position, each of lips 318, 320 engages a surface of core 262, to maintain core 262 in position within the opening defined by frame subassembly 260. Again, top cover member 276 can be removed by spreading legs 318, 320 apart so as to disengage serrations 308, 310 from grooves 322, 324, respectively, and exerting a pull-off force away from upper frame member 268.

Each side wall 312, 314 extends upwardly past web 316. Flanges 326, 328 extend inwardly toward each other from the upper ends of side walls 312, 314, respectively, defining a longitudinally extending slot 330 therebetween leading to a recess 332 defined by web 316 in combination with the upper ends of side walls 312, 314 and the undersides of flanges 326, 328.

Bottom cover member 278 is constructed identically to top cover member 276, and is secured to bottom frame member 270 in the same way as shown and described with respect to mounting of top cover member 276 to top frame member 268.

Referring to FIGS. 16 and 17, an end cap 334 is engaged with each corner of partition panel 58. Each end cap 334 is in the form of a generally U-shaped member having a closed end, and includes a pair of spaced side walls 336, 338 interconnected by a curved end wall 340. Walls 336–340 define a vertical cavity 342 sized so as to receive an end of one of side frame members 264, 266. The interior of cavity 342 is configured so as to engage the portions of side frame member 264 or 266 adjacent the curved contour of the outer wall of the top frame member 268 or bottom frame member 270 adjacent the side frame member to which end cap 334 is mounted. End cap 334 further includes a U-shaped vertically extending shoulder 344 and a squared C-shaped horizontally extending shoulder 346 bordering an opening providing access to cavity 342. With this arrangement, shoulder 344 overlies the side frame member 264 or 266 to which end cap 334 is mounted, and has a cross-section corresponding to the outer and side surfaces of the side frame member. Shoulder 346 extends over the curved horizontal-surface and the vertical surfaces of the top frame member 268 or bottom frame member 270 adjacent the side frame member to which end cap 334 is mounted.

The end of side cover member 274 overlies shoulder 344, and end cap walls 336, 340 define an outer contour substantially identical to that of side cover member 272. Similarly, top cover member 276 overlies shoulder 346.

The end of end cap 334 opposite shoulder 344 is closed by an annular ridge 348 located inwardly of a U-shaped land 350. A passage 352 extends inwardly from ridge 348, and a pair of opposed fingers 354 (FIG. 27) in part define passage 352. An angled surface 356 extends from land 350 and ridge 348, terminating in a projection 358 which provides end cap 334 with a contour similar to that of top cover member 276.

As can be appreciated, end caps 334 are engaged with the ends of side frame members 264, 266 prior to mounting of side cover members 272, 274 and top and bottom cover members 276, 278, respectively, to frame subassembly 260. Once cover members 272–278 are in place, end caps 334 are maintained in position by engagement of the ends of cover members 272–278 with the end cap shoulders such as 344, 346. In this manner, partition panel 58 can be assembled and disassembled without the need for tools simply by snapping off cover members 272–278 and end caps 334. If desired, core 262 can be changed to alter the fabric or make up of core 262, and partition panel 58 can then be reassembled easily and quickly as described above.

Referring to FIGS. 21–23, passage 352 is defined by an inner upper wall 360, a curved outer wall 362 extending downwardly from ridge 348, and a pair of side walls 364 within which fingers 354 are formed. A curved inner lower wall 366 extends downwardly from a step 368 located between the lower end of inner upper wall 360 and the upper end of inner lower wall 366.

Inner upper wall 360, outer wall 362 and side walls 364 fit snugly within the internal passage defined by the side frame member 264 or 266 to which end cap 334 is mounted. In a preferred embodiment, a series of projections 370 extend outwardly from walls 360–364 and engage the inner surfaces of the side frame member 264 or 266, so as to securely mount end cap 334 thereto.

Figure 24:
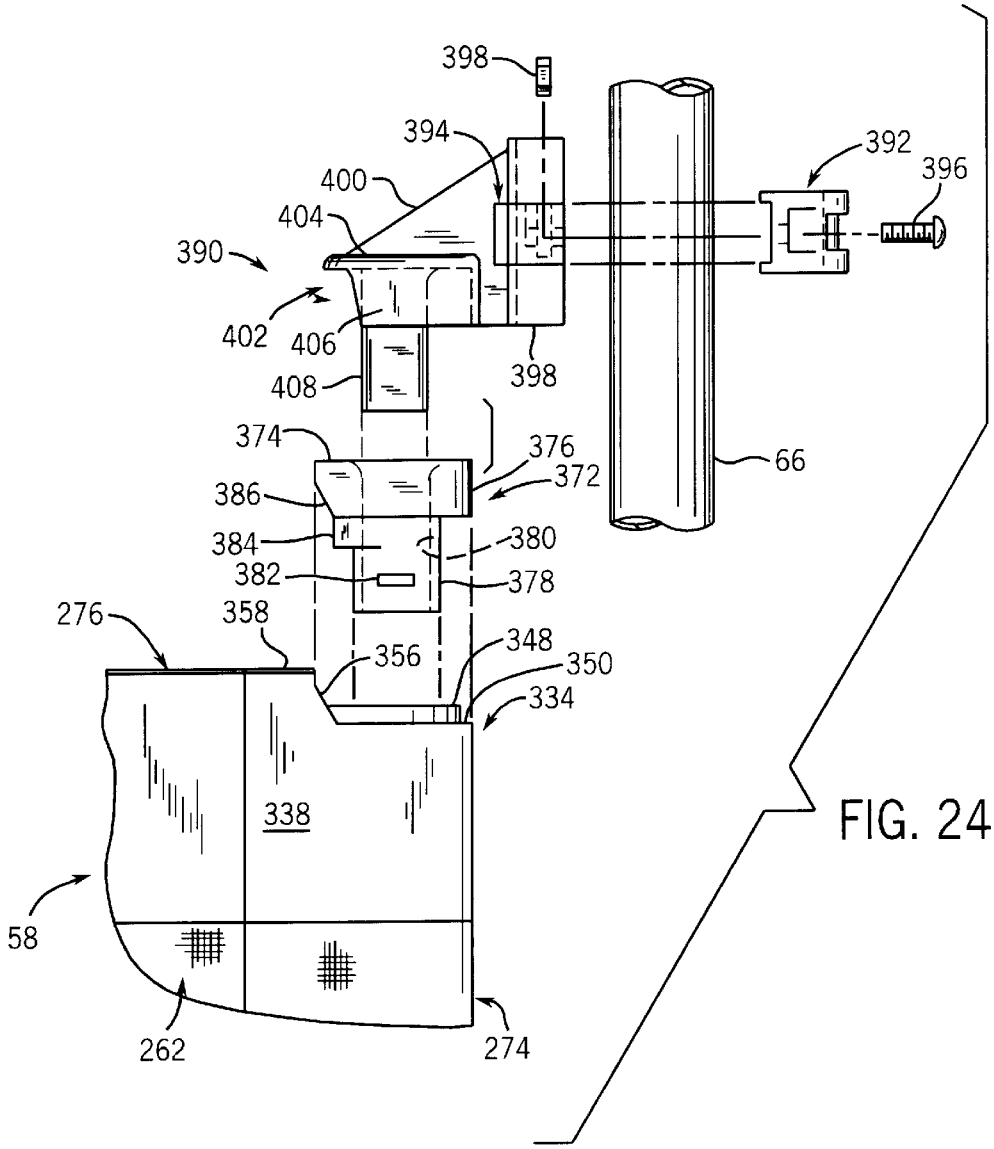
FIG. 24 is an exploded partial elevation view showing a corner of the panel of FIG. 16 and interconnection thereof with the column of FIG. 2.

FIG. 24 illustrates a receiver member 372 adapted for engagement with end cap 334. Receiver member 372 includes an upper section including an end wall 374 and a depending U-shaped side wall 376. A tubular member 378 extends downwardly from end wall 374, and defines an internal passage 380. A pair of indentations 382 are formed in the outer surface of tubular member 378 toward its lower end. A shoulder 384 extends inwardly from tubular member 378 toward its upper end, extending upwardly to the lower surface of end wall 374. The inner ends of side wall 376 terminate in an angled surface 386 which matches the angle of end cap angled surface 356.

Receiver member 372 is adapted for engagement with end cap 334 as shown in FIGS. 25 and 27. Tubular member 378 is pushed downwardly into end cap passage 352. The outside diameter of tubular member 378 is slightly smaller than the inside diameter of passage 352, such that tubular member 378 is snugly received within passage 352. Fingers 354 are provided with a slight inward bias, such that when tubular member 378 is fully received within passage 352, a protrusion 388 at the lower end of each finger 354 snaps into one of indentations 382. In this manner, receiver member 372 is releasably interconnected with end cap 334. Shoulder 384 rests on step 368 adjacent upper inner wall 360 of end cap 344, and end cap side wall 376 has a contour matching that of end cap side walls 336, 338 and 340. Angled surface 386 of receiver member 372 engages angled surface 356 of end cap 354, and the upper surface of end wall 374 is substantially flush with the upper surface of end cap projection 358. In this manner, receiver member 372 fills the void defined at the upper corner of end cap 334.

Passage 380 in receiver member 372 extends along a longitudinal axis parallel to that of the side frame member such as 264, 266 to which end cap 334 is mounted. Passage 380 is oval, and includes a flared upper end opening onto receiver member end wall 374.

FIGS. 24–27 illustrate a column-to-panel connection arrangement 390 for interconnecting one end of partition panel 58 with one of vertical rods 66 associated with column 56. Connection arrangement 390 includes an inner collar member 392 and an outer collar member 394. Collar members 392 and 394 are semicircular, and are adapted for interconnection about rod 66 for securing connection arrangement 390 thereto. Inner collar member 392 includes a passage for receiving a threaded fastener 396, and outer collar member 394 includes a vertical slot for receiving a nut 398 and an intersecting horizontal slot in alignment with the passage in inner collar member 392 to enable the shank of fastener 396 to engage the threaded passage of nut 398. Similar structure is provided on both sides of inner and outer collar members 392, 394, as shown in FIG. 26, so as to enable inner and outer collar members 392, 394, respectively, to be clamped onto rod 66.

Outer collar member 394 includes a vertically extending stabilizer 398 having an arcuate profile which provides engagement with the outer surface of rod 66. A vertical web 400 extends outwardly from stabilizer 398 and outer collar member 394, and a connection member 402 is mounted to web 400. Referring to FIG. 26, inner and outer collar members 392, 394, respectively, are adapted for placement within the interior of column 56 as defined by column covers 152. Web 400 extends through the space between adjacent ends of column covers 152.

Connector member 402 defines a top wall 404 and a depending side wall 406, which is sized and configured so as to enable top wall 374 and side wall 376 of receiver member 372 to nest within a space defined by top wall 404 and side wall 402. A stub shaft 408 extends downwardly from top wall 404, and includes an outwardly flared upper portion which matches the profile of passage 380 in receiver member 372. Stub shaft 408 is also oval in cross-section, corresponding to the oval cross-section of passage 380. In this manner, stub shaft 408 is received within passage 380 as shown in FIGS. 25 and 27. With this arrangement, orientation of partition panel 58 relative to rod 66 is predetermined according to the orientation of slot 380 and shaft 408. Typically, partition panel 58 extends radially outwardly relative to column 56.

A connection arrangement 390 is also provided toward the lower end of rod 66 for engagement with a receiver member 372 mounted to the end cap 334 at the lower-end of the partition panel 58. In this manner, panel 58 is mounted to column 56 utilizing a two-point top and bottom mounting arrangement. As can be appreciated, the bottom connection arrangement 390 is installed first, and the top connection arrangement 390 is installed after connection of the bottom of partition panel 58 to the bottom connection arrangement 390.

Figure 28:
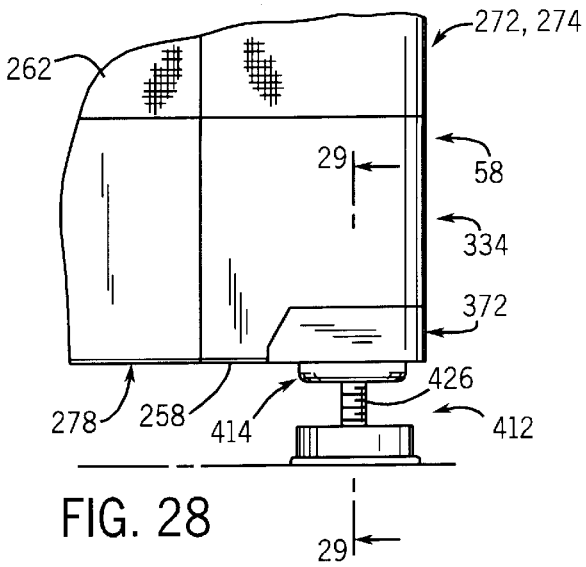
FIG. 28 is a partial elevation view showing a lower corner of the panel of FIG. 16.
Figure 29:
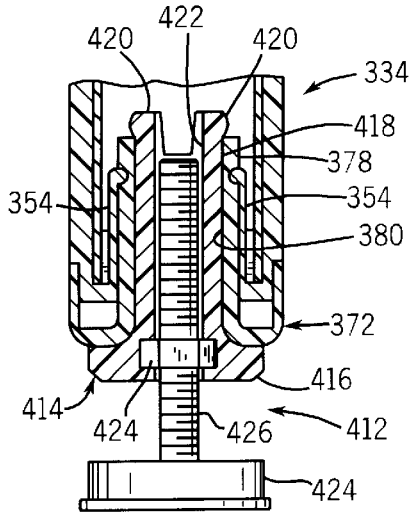
FIG. 29 is a partial section view taken along line 29—29 of FIG. 28.

FIG. 28 shows a support arrangement for supporting partition panels 58 at locations other than at column 56. As previously explained, an end cap 334 is mounted to the lower end of one of side frame members 264 or 266, and a receiver member 372 is engaged with end cap 334 as described above. In this case, however, passage 380 of receiver member 372 faces downwardly toward the floor.

A glide assembly 412 is engaged with receiver member 372. Glide assembly 412 includes a glide mount 414 defining a head 416 adapted for engagement with end wall 374 of receiver member 372. A neck 418 extends from head 416. Neck 418 terminates in opposed outward projections 420. A passage 422 extends between the lower end of head 416 and the upper end of neck 418 between projections 420. A nut 424 is embedded within head 416, and includes a threaded passage in alignment with passage 422.

Glide assembly 412 further includes a glide member 424 having a threaded shaft 426 extending upwardly therefrom. Glide assembly 412 is assembled to end cap 334 by inserting neck 418 into receiver member passage 380 until projections 420 clear the ends of tubular member 378 of receiver member 372, which retains glide mount 414 in position relative to end cap 334. Shaft 426 is then engaged with nut 424 and screwed into the desired position, to level partition panel 58.

Figure 31:
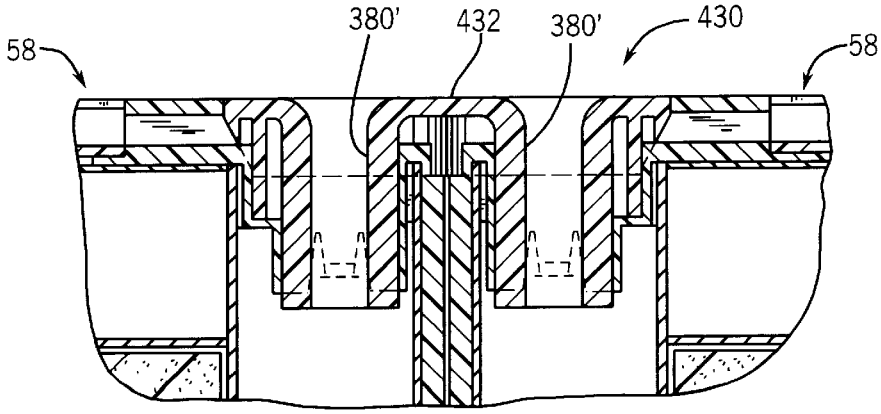
FIG. 31 is a partial section view taken along line 31—31 of FIG. 30.
Figure 30:
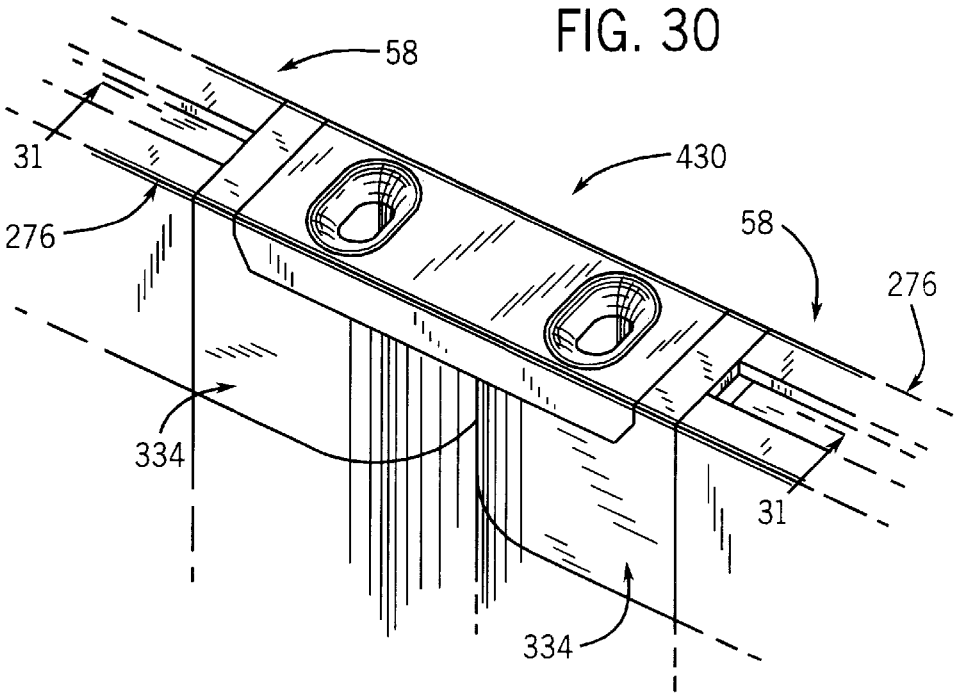
FIG. 30 is a partial isometric view showing two partition panels of FIG. 16 in an end-to-end relationship and an in-line connector for securing the panels together.

FIGS. 30 and 31 illustrate a straight line panel-to-panel connector 430 for engaging adjacent partition panels 58 together in an end-to-end non-pivotable relationship. Connector 430 is illustrated as interconnected with the panel upper ends, and a similar panel-to-panel connector 430 is engaged with the panel lower ends. Connector 430 defines a pair of passages 380', and a glide assembly 412 is engaged with each passage 380' in the connector 430 engaged with the panel lower ends.

Essentially, straight line panel-to-panel connector 430 is in the form of a pair of receiver members 372 formed integrally with each other in a back-to-back relationship, spanning between adjacent partition panels 58. The interrelationship of connector 430 with adjacent end caps 334 is illustrated in FIG. 31, and it is believed additional explanation is unnecessary due to the above explanation of the manner in which receiver member 372 is engaged with each end cap 334. In the case of connector 430, however, a bridging section 432 (FIG. 31) interconnects each portion of connector 430 analogous to receiver members 372 when positioned in a back-to-back relationship.

Figure 32:
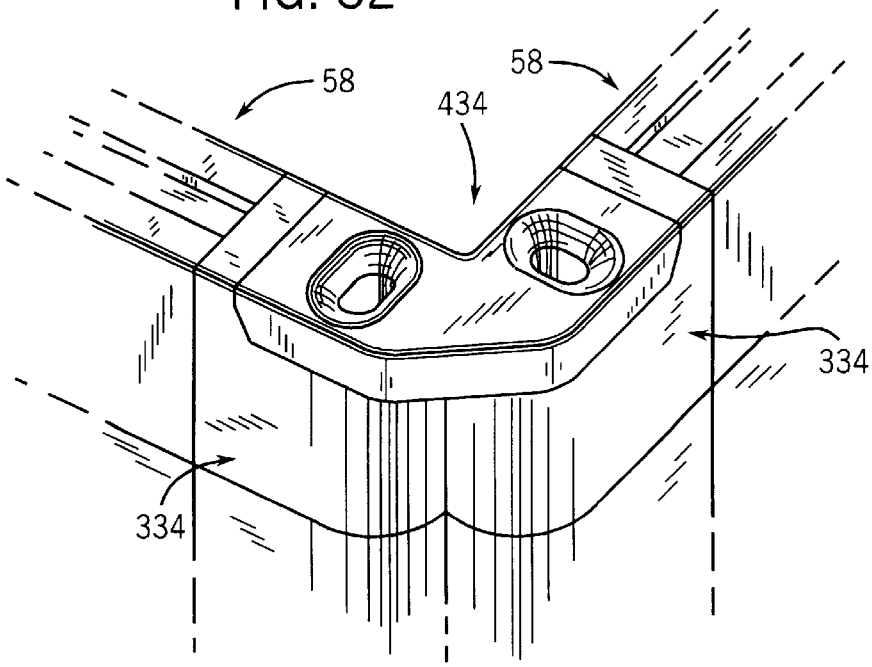
FIG. 32 is a partial isometric view similar to FIG. 30, showing adjacent panels in a perpendicular relationship and a connector for securing the panels together.
Figure 33:
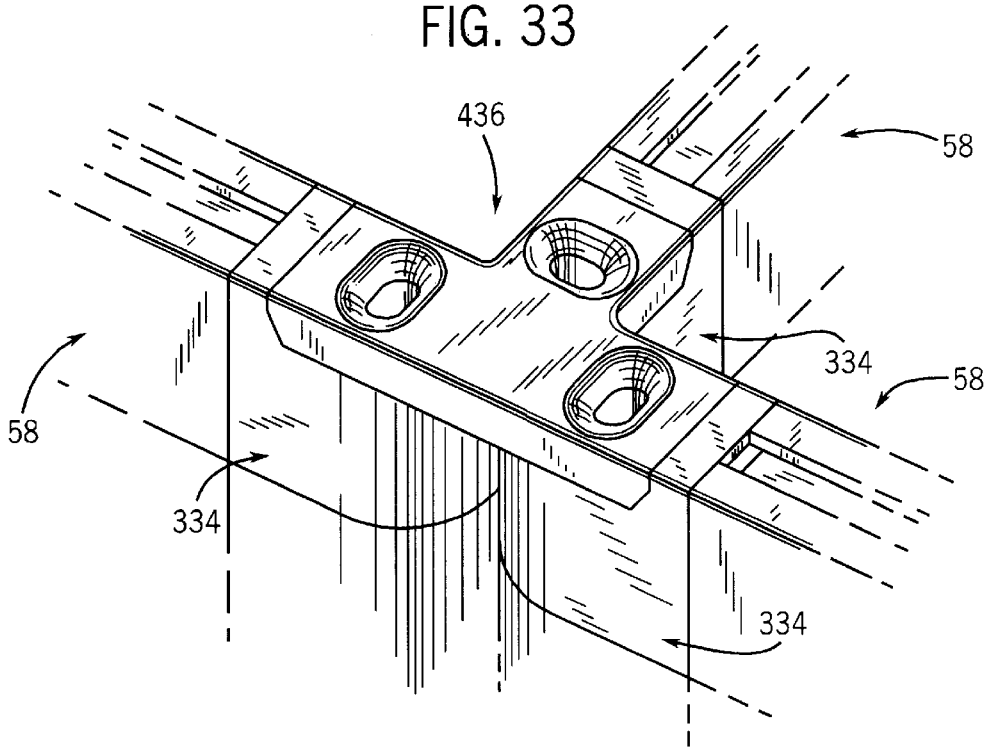
FIG. 33 is a partial isometric view similar to FIGS. 30 and 32, showing three partition panels in a "T" configuration and a connector for securing the panel ends together.
Figure 34:
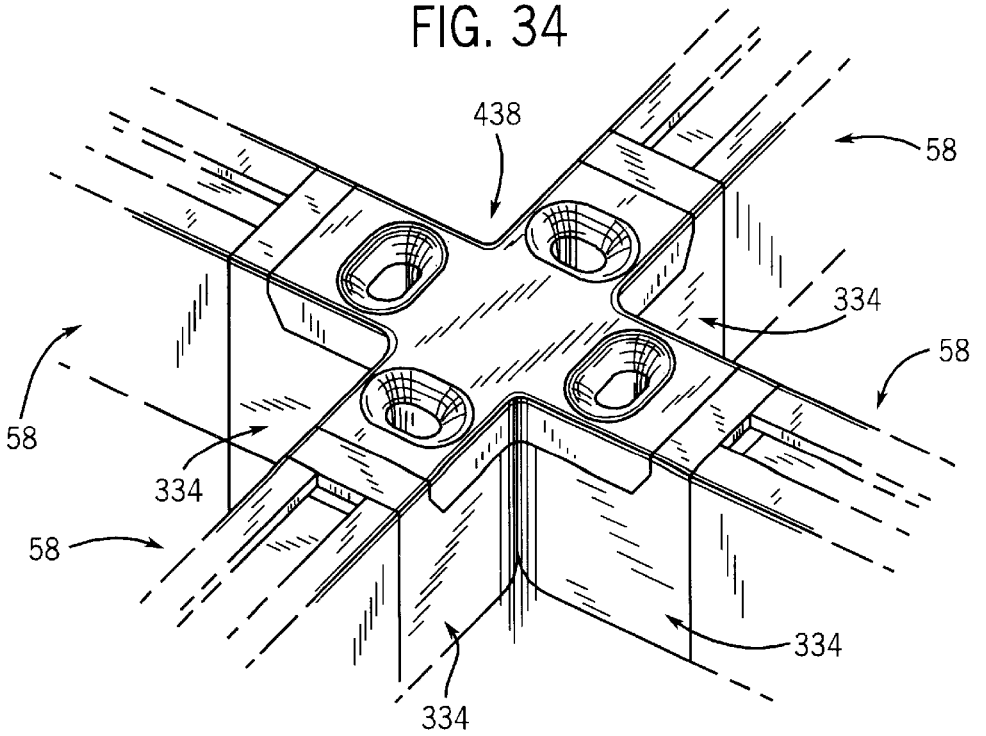
FIG. 34 is a view similar to FIGS. 30, 32 and 33, showing four partition panels in an "X" configuration and a connector for securing the panel ends together.
Figure 37A:
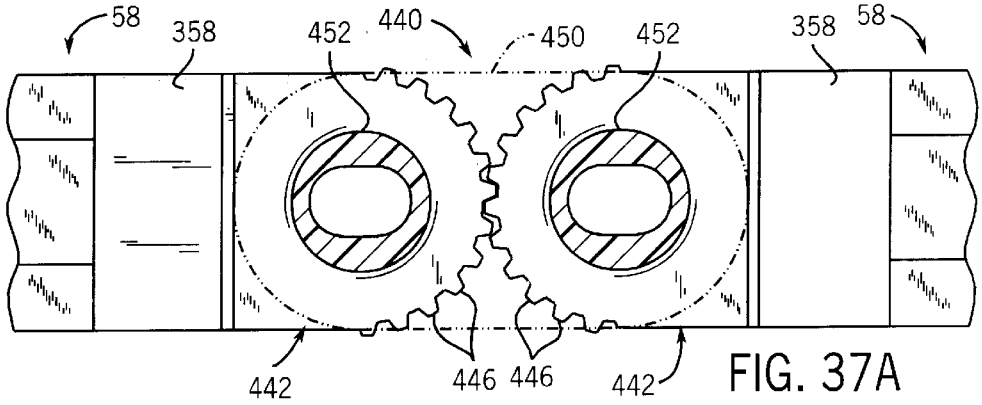
FIG. 37*a* is a partial section view taken along line 37*a*—37*a* of FIG. 35.
Figure 37B:
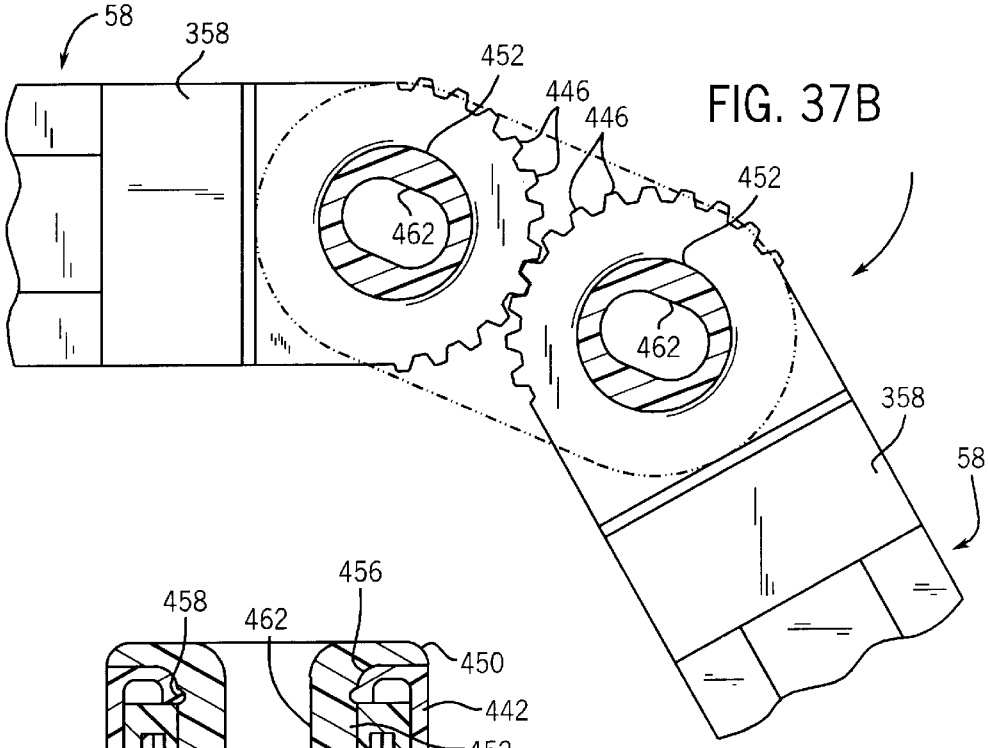
FIG. 37*b* is a view similar to FIG. 37*a*, showing pivoting movement of one of the partition panels relative to the other.

Similarly, FIGS. 32–34 illustrate other configurations for non-pivotable panel-to-panel connectors. FIG. 32 illustrates adjacent panels 58 positioned perpendicularly to each other, with a 90° panel-to-panel connector 434 interconnecting the upper-and lower ends of panels 58. Panel-to-panel connector 434 is in the form of a pair of receiver members 372 integrally formed together in a back-to-back relationship, in which the longitudinal axes of receiver members 372 are perpendicular to each other. FIG. 33 illustrates a 3-panel T-shaped connector 436 for non-pivotably interconnecting three adjacent panel ends. In this case, three structures analogous to receiver member 372 are interconnected together at a center and extend outwardly therefrom, and engage end caps 334 in the same manner as set forth above with respect to receiver member 372 for non-pivotably securing three adjacent panels 58 together. FIG. 34 illustrates a 4-panel X-shaped connector 438 in which four structures analogous to receiver member 372 are placed back-to-back and extend outwardly from a center, for interconnecting four adjacent partition panel ends.

FIGS. 35–38 illustrate a pivoting panel-to-panel connector assembly 440 for pivotably interconnecting adjacent panels 58. In this embodiment, end caps 334 are constructed and function the same as set forth above.

Pivotable connector assembly 440 includes a pair of gear members 442. Each gear member 442 is configured similarly to the void defined at the corner of each end cap 334. Each gear member 442 defines a downwardly facing recess which receives ridge 348, and includes an angled surface 444 which matches the angle of end cap angled surface 356. Each gear member 442 further defines a series of teeth 446 which engage each other when gear members 442 are mounted to adjacent end caps 334. Gear members 442 are non-rotatable, and simply function to maintain engagement with each other through teeth 446.

Figure 38:
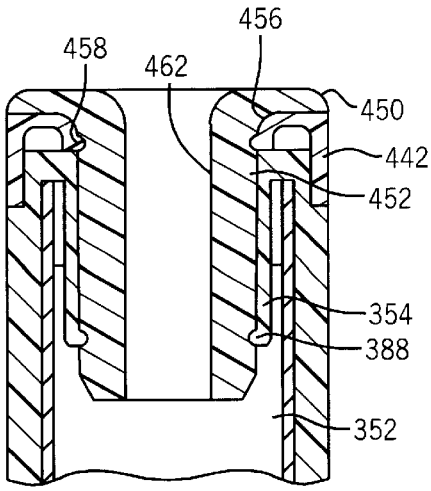
FIG. 38 is a partial section view taken along line 38—38 of FIG. 35.

Pivotable connector assembly 440 further includes a spanning pivot member 448, which includes an end plate 450 and a pair of depending pivot hubs 452 extending from opposite ends of end plate 450. Each pivot hub 452 is adapted for engagement within the passage 352 of one of end caps 334. As shown in FIG. 38, each pivot hub 452 includes a lower annular groove 454 which receives protrusions 388 of fingers 354. In addition, each gear member 442 defines an opening 456 enabling pivot hub 452 to pass therethrough, and a projection 458 at opening 456 is engaged within an upper groove 460 formed in each pivot hub 452. Each pivot hub 452 includes a passage 462.

With this arrangement, the user can impart pivoting movement between adjacent partition panels 58. When pivoting movement of one of panels 58 commences, gear teeth 456 ensure that the upper and lower ends of the panel 58 pivot in a synchronous fashion.

FIGS. 39 and 40 illustrate the manner in which partition panels 58 can be stacked one upon another. As can be appreciated, the components engageable with end caps 334, such as receiver member 372, panel-to-panel connectors 430, 434, 436 and 438, as well as pivot hubs 452, define upwardly open oval passages. A stacking pin 462 can be engaged within the upwardly open passage, and includes a lower portion engageable with the structure defining the passage by means of projections 464, as well as an upper portion engageable within the downwardly facing passage having similar connector structure. A flared intermediate portion 468 accommodates the flare of the facing passages, and the shape of pin 462 corresponds to the cross-section of the passages to ensure proper orientation between the stacked panels.

FIG. 41 illustrates an auxiliary component for mounting to top cover members 276. As shown, a base 470 is received within recess 332 through slot 330. A pair of spaced support members 472 extend upwardly from base 470, and are adapted to support a transparent divider or screen 474, as shown in FIG. 1. In this manner, the upper end of top cover member 276 can be utilized to support any number of auxiliary items, such as work surface support brackets, shelf support brackets, overhead storage cabinets, paper management devices, etc.

FIG. 42 illustrates a post corner for adjacent partition panels 58. In this embodiment, a post 476 is located adjacent the end of each of a pair of panels 58. A panel-to-panel connector 476 is formed similarly to panel-to-panel connector 434 as described previously with respect to FIG. 32, but includes a top plate 480 which overlies and engages the upper end of post 476. In all other respects, the manner in which connector 478 is mounted to end caps 334 is the same as described previously, and post 476 lends structural support which can assist in stabilizing a panel arrangement incorporating a perpendicular intersection as shown in FIGS. 42 and 43.

FIG. 44 illustrates an alignment arrangement for adjacent panels 58, and is typically utilized when panels 58 are pivotable relative to each other using pivotable connector assembly 440 having the same construction as described previously with respect to FIGS. 35–38. Spanning pivot member 448 is not shown in FIG. 44. In this embodiment, a groove 484 is formed in the outer surface of each end cap 334, extending about curved end wall 340 of end cap 334. Each groove 484 includes a projection 486 at its opposite ends. Grooves 484 are in alignment with each other when panels 58 are installed. A clip member 488 is engaged within one of grooves 484. Clip member 488 extends beyond the outer edge of the end cap 334 to which it is mounted, and into the groove 484 in the adjacent end cap 334. Clip member 488 includes notches at its ends which receive projections 486, so that clip member 488 can be snapped in place after panels 58 have been placed adjacent each other. The receipt of clip member 488 in the groove 484 in the adjacent end cap 334 ensures that adjacent panels 58 are maintained in vertical alignment with each other, since clip member 488 has a height only slightly less than that of groove 484. Adjacent panels 58 are thus positively retained in vertical position relative to each other by engagement of clip member 488 in one end cap 334 within groove 484 in the adjacent end cap 334.

Various alternatives and embodiments are contemplated as being within the scope of the following claims particularly pointing out and distinctly claiming the subject matter regarded as the invention.

We claim:

1. A space dividing system, comprising:

a column including a power receptacle arrangement, wherein the column defines a vertical longitudinal axis and an outer periphery, and includes a series of spaced vertical structural members centered on the vertical longitudinal axis of the column and radially spaced from each other about the outer periphery defined by the column, and wherein the power receptacle arrangement includes a series of radially spaced outwardly facing power outlets, each of which is located between an adjacent pair of vertical structural members;

a series of partition panels, wherein each partition panel is secured to one of the vertical structural members of the column and wherein each power outlet is located between an adjacent pair of partition panels, and wherein the partition panels and the vertical structural members of the column are constructed and arranged such that a power outlet is located between each adjacent pair of vertical structural members and partition panels; and a pivot connection arrangement interposed between each partition panel and one of the vertical structural members of the column for pivotably mounting each partition panel to the column.

2. The space dividing system of claim 1, wherein the column includes an upper end member and a lower end member, and wherein the series of vertical structural members extend between the upper and lower end members.

3. The space dividing system of claim 1, wherein the column is adapted to be positioned within a space having a ceiling, and wherein the column includes an upper end member and defines a height less than the height of the space such that the upper end member is adapted to be spaced below the ceiling, and further comprising a variable height engagement arrangement interconnected with the upper end member and adapted for engagement with the ceiling.

4. A space dividing system, comprising:

a space defined at least in part by a fixed-height ceiling located above a floor, wherein the ceiling includes a series of fixed-height structural ceiling members;

a column defining an upper end and a lower end, and a series of vertical structural members interconnected with the upper and lower ends and extending therebetween, wherein the column includes a power receptacle arrangement, and wherein the lower end of the column is adapted to be supported by the floor and the upper end of the column is adapted to be spaced below the ceiling, wherein the height of the space between the upper end of the column and the ceiling is variable;

a rigid upper connection arrangement extending from the column upper end, wherein the rigid upper connection arrangement includes a connection member having a selectively engageable variable position engagement arrangement engaged with one of the ceiling members, wherein the connection member comprises an adjustable length member interconnected with and extending upwardly from the upper end of the column, wherein the length of the adjustable length member above the upper end of the column is adjustable according to the height of the space between the fixed height ceiling and the upper end of the column; and at least a pair of partition panels mounted to the column, wherein each partition panel is mounted to one of the vertical structural members by means of a pivot connection for providing pivoting movement of the partition panel relative to the column.

5. The space dividing system of claim 4, wherein the power receptacle arrangement is mounted to the vertical structural members.

6. The space dividing system of claim 5, wherein the power receptacle arrangement is interconnected with a mounting bracket structure, wherein the mounting bracket structure is secured to the vertical structural members.

7. The space dividing system of claim 5, wherein the column includes cover structure engageable with the vertical structural members for concealing an internal space defined by the column between the upper and lower end members.

8. A space dividing system for use in a space including a floor, comprising:

a columnar assembly adapted for engagement with the floor, wherein the columnar assembly defines a vertical longitudinal axis and an outer periphery, and includes an upper end member, a lower end member, and a plurality of vertical structural members centered on the vertical longitudinal axis and radially spaced from each other about the outer periphery defined by the columnar assembly, wherein the vertical structural members are interconnected with the upper and lower members and extend therebetween;

a plurality of partition panels, wherein each partition panel includes a pair of vertical side frame members and top and bottom transverse frame members extending between the side frame members, wherein the partition panels include a floor engagement arrangement separate from the columnar assembly adapted for engagement with the floor separately from the columnar assembly; and a pivot connection arrangement interposed between each partition panel and one of the vertical structural members of the columnar assembly for pivotably mounting each partition panel to the columnar assembly.

9. The space dividing system of claim 8, wherein the column includes cover structure engageable with the vertical structural members for concealing an internal space defined by the column between the upper and lower end members.

10. The space dividing system of claim 9, wherein the cover structure comprises a series of cover members, wherein each cover member is engageable with and between a pair of vertical structural members.

11. The space dividing system of claim 10, wherein each cover member includes outer wall structure extending between a pair of engagement members, wherein each engagement member is engageable with one of the vertical structural members.

12. The space dividing system of claim 8, further comprising a power receptacle arrangement mounted to at least one of the vertical structural members.

13. The space dividing system of claim 12, wherein the power receptacle arrangement is interconnected with a mounting bracket structure, wherein the mounting bracket structure is secured to one of the vertical structural members.

14. The space dividing system of claim 8, wherein the column includes cover structure engageable with the vertical structural members for concealing an internal space defined by the column between the upper and lower end members.

15. The space dividing system of claim 14, wherein the cover structure comprises a series of cover members, wherein each cover member is engageable with and between a pair of vertical structural members.

16. The space dividing system of claim 15, wherein each cover member includes outer wall structure extending between a pair of engagement members, wherein each engagement member is engageable with one of the vertical structural members.

17. The space dividing system of claim 8, further comprising a power receptacle arrangement mounted to one of the vertical structural members at a location at which the power receptacle arrangement is spaced from each of the upper and lower end members, and wherein the column further comprises cover structure including an upper cover member releasably engageable with a pair of the vertical structural members and extending between the upper end member and an upper surface defined by the power receptacle arrangement, and a lower cover member releasably engageable with a pair of the vertical structural members and extending between the lower end member and a lower surface defined by the power receptacle arrangement.

18. The space dividing system of claim 8, wherein at least one vertical side frame member of each partition panel defines an upper end and a lower end adjacent the column, and wherein the pivot connection comprises upper and lower pivot assemblies mounted to one of the vertical structural members and interconnected with the upper and lower ends, respectively, of the vertical side frame member.

19. The space dividing system of claim 8, wherein the column defines a height less than the height of the space within which the space dividing system is positioned such that the upper end member is adapted to be spaced below a ceiling associated with the space, and further comprising a variable height engagement arrangement interconnected with the upper end member and adapted for engagement with the ceiling.

20. The space dividing system of claim 8, wherein each of the partition panels comprises a series of panels pivotably interconnected with each other, wherein an endmost one of the panels is pivotably mounted to the column.

21. A space dividing system, comprising:

a column including a power receptacle arrangement, wherein the column defines a vertical longitudinal axis and an outer periphery, and includes an upper end member, a lower end member, and a series of spaced vertical structural members extending between the upper and lower end members and centered on the vertical longitudinal axis of the column, wherein the vertical structural members are radially spaced from each other about the outer periphery defined by the column, and wherein the power receptacle arrangement includes a series of radially spaced outwardly facing power outlets, each of which is located between an adjacent pair of vertical structural members, wherein the power receptacle arrangement is interconnected with a mounting bracket structure, and wherein the mounting bracket structure is secured to the vertical structural members; and a series of partition panels, wherein each partition panel is secured to one of the vertical structural members of the column and wherein each power outlet is located between an adjacent pair of partition panels, and wherein the partition panels and the vertical structural members of the column are constructed and arranged such that a power outlet is located between each adjacent pair of vertical structural members and partition panels.

22. A space dividing system, comprising:

a column including a power receptacle arrangement, wherein the column comprises an upper end member, a lower end member, and a series of vertical structural members interconnected with the upper and lower end members and extending therebetween, wherein the power receptacle arrangement is mounted to the vertical structural members;

at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column; and column cover structure engageable with the vertical structural members for concealing an internal space defined by the column between the upper and lower end members, wherein the column cover structure comprises a series of cover members, wherein each cover member is engageable with and between a pair of vertical structural members, wherein each cover member includes outer wall structure extending between a pair of engagement members, wherein each engagement member is engageable with one of the vertical structural members, and wherein the engagement members are releasably engageable with a pair of the vertical structural members in response to application of an inward push-on force to the cover member.

23. A space dividing system, comprising:

a column including a power receptacle arrangement and upper and lower end members, wherein the column defines a vertical longitudinal axis and an outer periphery, and includes a series of spaced vertical structural members extending between the upper and lower end members, wherein the vertical structural members are centered on the vertical longitudinal axis of the column and radially spaced from each other about the outer periphery defined by the column, and wherein the power receptacle arrangement includes a series of radially spaced outwardly facing power outlets, each of which is located between an adjacent pair of vertical structural members;

a series of partition panels, wherein each partition panel is secured to one of the vertical structural members of the column and wherein each power outlet is located between an adjacent pair of partition panels, and wherein the partition panels and the vertical structural members of the column are constructed and arranged such that a power outlet is located between each adjacent pair of vertical structural members and partition panels; and cover structure engageable with the vertical structural members for concealing an internal space defined by the column between the upper and lower end members, wherein the power receptacle arrangement is mounted to the vertical structural members at a location at which each power outlet is spaced from each of the upper and lower end members, and wherein the cover structure includes an upper cover member releasably engageable with each adjacent pair of vertical structural members and extending between the upper end member and an upper surface defined by the power outlet, and a lower cover member releasably engageable with each adjacent pair of vertical structural members and extending between the lower end member and a lower surface defined by the power outlet.

24. A space dividing system, comprising:

a column including a power receptacle arrangement and upper and lower end members, wherein the column defines a vertical longitudinal axis and an outer periphery, and includes a series of spaced vertical structural members extending between the upper and lower end members and centered on the vertical longitudinal axis of the column, wherein the vertical structural members are radially spaced from each other about the outer periphery defined by the column, and wherein the power receptacle arrangement includes a series of radially spaced outwardly facing power outlets, each of which is located between an adjacent pair of vertical structural members; and a series of partition panels, wherein each partition panel is pivotably connected to one of the structural members of the column and wherein each power outlet is located between an adjacent pair of partition panels, and wherein the partition panels and the vertical structural members of the column are constructed and arranged such that a power outlet is located between each adjacent pair of vertical structural members and partition panels.

25. The space dividing system of claim 24, wherein each partition panel is mounted to a vertical structural member by means of a pivot connection for providing pivoting movement of the partition panel relative to the column.

26. The space dividing system of claim 25, wherein each partition panel includes a structural frame assembly defining an upper end and a lower end adjacent the column, and wherein the pivot connection comprises upper and lower pivot assemblies mounted to one of the vertical structural members and interconnected with the upper and lower ends, respectively, of the partition panel frame assembly.

27. A space dividing system, comprising:

a column including a power receptacle arrangement, wherein the column comprises an upper end member, a lower end member, and a series of vertical structural members interconnected with the upper and lower end members and extending therebetween, wherein the power receptacle arrangement is mounted to the vertical structural members; and at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column;

wherein each partition panel is pivotably mounted to one of the vertical structural members by means of a pivot connection for providing pivoting movement of the partition panel relative to the column, wherein each partition panel includes a structural frame assembly defining an upper end and a lower end adjacent the column, and wherein the pivot connection comprises upper and lower pivot assemblies mounted to one of the vertical structural members and interconnected with the upper and lower ends, respectively, of the partition panel frame assembly, and wherein each pivot assembly comprises a pivot connection member adapted for mounting to one of the vertical structural members, wherein the pivot connection member includes a longitudinally extending pivot shaft offset from the vertical structural member, and a pivot receiver mounted to the structural frame assembly and defining a vertical recess within which the pivot shaft is received, for providing pivoting movement of the partition panel about a vertical pivot axis offset from a vertical longitudinal axis defined by the vertical structural member of the column.

28. The space dividing system of claim 27, wherein the pivot connection member is removably engageable with the vertical structural member of the column.

29. The space dividing system of claim 27, wherein the partition panel includes a cover arrangement engageable with the structural frame assembly, and wherein the pivot receiver is mounted to the structural frame assembly separate from the cover arrangement.

30. The space dividing system of claim 29, wherein the cover arrangement defines a recess located at upper and lower ends defined by the structural frame assembly, and wherein each pivot receiver is adapted for engagement with an end defined by the structural frame assembly and is received within one of the recesses defined by the cover arrangement.

31. A space dividing system, comprsing:

a column including a power receptacle arrangement, wherein the column is adapted to be positioned within a space having a ceiling, and wherein the column includes an upper end member and defines a height less than the height of the space such that the upper end member is adapted to be spaced below the ceiling, and further comprising a variable height engagement arrangement interconnected with the upper end member and adapted for engagement with the ceiling, wherein the variable height engagement arrangement comprises a mounting rod receivable within a sleeve interconnected with the upper end member, wherein the mounting rod defines an upper end and wherein the variable height engagement arrangement includes a ceiling engagement arrangement secured to the upper end of the mounting rod, wherein the mounting rod is longitudinally movable within a passage defined by the sleeve for varying the elevation of the ceiling engagement arrangement relative to the upper end member, and further comprising a locking arrangement for selectively fixing the mounting rod to the sleeve for preventing relative movement between the mounting rod and the upper end member when the ceiling engagement arrangement is adapted to be engaged with the ceiling; and at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column.

32. A space dividing system, comprising:

a column including a power receptacle arrangement;

at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column;

wherein the column is adapted to be positioned within a space having a ceiling, and wherein the column includes an upper end member and defines a height less than the height of the space such that the upper end member is adapted to be spaced below the ceiling;

a variable height engagement arrangement interconnected with the upper end member and adapted for engagement with the ceiling; and one or more luminaires for mounting to the upper end member of the column, wherein each luminaire comprises a lighting member secured to a mounting member, wherein the mounting member is adapted for engagement with the upper end member of the column and is configured such that the lighting member is located exteriorly of the column and spaced outwardly therefrom.

33. The space dividing system of claim 32, wherein each luminaire mounting member comprises a mounting arm defining an upper end to which the lighting member is mounted and a lower end adapted to be received within a sleeve interconnected with the upper end member.

34. The space dividing system of claim 33, wherein the lower end of the luminaire mounting arm is movable within the sleeve to vary the position of the lighting member relative to the column, and further comprising a locking arrangement associated with the sleeve for selectively fixing the position of the luminaire mounting member relative to the upper end member.

35. The space dividing system of claim 32, wherein the variable height engagement arrangement comprises a mounting rod adapted for engagement with the upper end member of the column, and wherein each luminaire mounting member is located outwardly of the mounting rod.

36. The space dividing system of claim 35, further comprising a cover arrangement engageable with the upper end member of the column and defining an internal space within which the mounting rod is received, wherein the cover member is adapted to extend between the ceiling and the upper end member of the column, and wherein the luminaire mounting members are located outwardly of the cover member.

37. A space dividing system, comprising:

a column including a power receptacle arrangement;

at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column;

wherein the column is adapted to be positioned within a space having a ceiling, and wherein the column includes an upper end member and defines a height less than the height of the space such that the upper end member is adapted to be spaced below the ceiling;

a variable height engagement arrangement interconnected with the upper end member and adapted for engagement with the ceiling; and a cover arrangement engageable with the upper end member of the column and adapted to span between the ceiling and the upper end member.

38. The space dividing system of claim 37, wherein the variable height engagement arrangement comprises a mounting rod defining an upper end and a ceiling engagement arrangement secured to the mounting rod upper end, and wherein the cover arrangement defines an internal space within which the mounting rod is received for concealing the mounting rod between the ceiling and the upper end member of the column.

39. The space dividing system of claim 38, wherein the cover arrangement comprises a tubular cover member having a lower end adapted for interconnection with the upper end member of the column, and an upper end adapted for positioning adjacent a downwardly facing surface defined by the ceiling.

40. A space dividing system, comprising:

a column including a power receptacle arrangement;

at least a pair of partition panels, wherein the pair of partition panels are secured to the column at spaced locations and wherein the power receptacle arrangement is located on the column so as to be accessible from between the pair of partition panels, and wherein at least one of the pair of partition panels is pivotably mounted to the column;

wherein the column includes an upper end member and is adapted to be positioned within a space having a ceiling, wherein the column defines a height less than the height of the space such that the upper end member is adapted to be spaced below the ceiling, and further comprising a lighting arrangement interconnected with the upper end member, wherein the lighting arrangement is adapted to be positioned between the ceiling and the upper end member, and wherein the partition panels are interconnected with the column below the upper end member of the column.

41. The space dividing system of claim 40, wherein the column further includes a series of vertical structural members located below the upper end member, wherein each partition panel is pivotably interconnected with one of the vertical structural members of the column.

42. The space dividing system of claim 41, further comprising a ceiling engagement arrangement interconnected with the upper end member of the column and extending upwardly therefrom, wherein the ceiling engagement arrangement is adapted to be engaged with the ceiling of the space within which the space dividing system is located.

43. A space dividing system, comprising:

a column including a power receptacle arrangement, wherein the column defines a vertical longitudinal axis and an outer periphery, and includes a series of spaced vertical structural members centered on the vertical longitudinal axis of the column and radially spaced from each other about the outer periphery defined by the column, and wherein the power receptacle arrangement includes a series of radially spaced outwardly facing power outlets, each of which is located between an adjacent pair of vertical structural members;

a series of partition panels, wherein each partition panel is secured to one of the vertical structural members of the column and wherein each power outlet is located between an adjacent pair of partition panels, and wherein the partition panels and the vertical structural members of the column are constructed and arranged such that a power outlet is located between each adjacent pair of vertical structural members and partition panels, wherein each of the partition panels comprises a series of panels pivotably interconnected with each other and wherein an endmost one of the panels is pivotably mounted to the column.

44. A space dividing system, comprising:

a column including a power receptacle arrangement, wherein the column comprises an upper end member, a lower end member, and a series of vertical structural members interconnected with the upper and lower end members and extending therebetween, wherein the power receptacle arrangement is mounted to the vertical structural members, and at least a pair of partition panels, wherein the pair of partition panels are secured to the column at spaced locations and wherein the power receptacle arrangement is accessible from between the pair of partition panels, wherein each partition panel is mounted to one of the vertical structural members by means of a pivot connection for providing pivoting movement of the partition panel relative to the column, wherein each partition panel includes a structural frame assembly defining an upper end and a lower end adjacent the column, and wherein the pivot connection comprises upper and lower pivot assemblies mounted to one of the vertical structural members and interconnected with the upper and lower ends, respectively, of the partition panel frame assembly, wherein each pivot assembly comprises a pivot connection member adapted for mounting to one of the vertical structural members, wherein the pivot connection member includes a longitudinally extending pivot shaft offset from the vertical structural member, and a pivot receiver mounted to the structural frame assembly and defining a vertical recess within which the pivot shaft is received, for providing pivoting movement of the partition panel about a vertical pivot axis offset from a vertical longitudinal axis defined by the vertical structural member of the column.

45. The space dividing system of claim 44, wherein the pivot connection member is removably engageable with the vertical structural member of the column.

46. The space dividing system of claim 44, wherein the partition panel includes a cover arrangement engageable with the structural frame assembly, and wherein the pivot receiver is mounted to the structural frame assembly separate from the cover arrangement.

47. The space dividing system of claim 46, wherein the cover arrangement defines a recess located at upper and lower ends defined by the structural frame assembly, and wherein each pivot receiver is adapted for engagement with an end defined by the structural frame assembly and is received within one of the recesses defined by the cover arrangement.

48. A space dividing system, comprising:

a column including a power receptacle arrangement, wherein the column includes an upper end member and is adapted to be positioned within a space having a ceiling, wherein the column defines a height less than the height of the space such that the upper end member is adapted to be spaced below the ceiling;

a variable height engagement arrangement interconnected with the upper end member and adapted for engagement with the ceiling;

at least a pair of partition panels, wherein the pair of partition panels are secured to the column at spaced locations and wherein the power receptacle arrangement is accessible from between the pair of partition panels;

one or more luminaires adapted for mounting to the upper end member of the column, wherein each luminaire comprises a lighting member secured to a mounting member, wherein the mounting member is adapted for engagement with the upper end member of the column and is configured such that the lighting member is located exteriorly of the column and spaced outwardly therefrom, wherein each luminaire mounting member comprises a mounting arm defining an upper end to which the lighting member is mounted and a lower end adapted to be received within a sleeve interconnected with the upper end member.

49. The space dividing system of claim 48, wherein the lower end of the luminaire mounting arm is movable within the sleeve to vary the position of the lighting member relative to the column, and further comprising a locking arrangement associated with the sleeve for selectively fixing the position of the luminaire mounting member relative to the upper end member.

50. A space dividing system, comprising:

a column including a power receptacle arrangement, wherein the column includes an upper end member and is adapted to be positioned within a space having a ceiling, wherein the column defines a height less than the height of the space such that the upper end member is adapted to be spaced below the ceiling;

a variable height engagement arrangement interconnected with the upper end member and adapted for engagement with the ceiling;

at least a pair of partition panels, wherein the pair of partition panels are secured to the column at spaced locations and wherein the power receptacle arrangement is accessible from between the pair of partition panels; and one or more luminaires for mounting to the upper end member of the column, wherein each luminaire comprises a lighting member secured to a mounting member, wherein the luminaire mounting member is adapted for engagement with the upper end member of the column and is configured such that the lighting member is located exteriorly of the column and spaced outwardly therefrom;

wherein the variable height engagement arrangement comprises a mounting rod adapted for engagement with the upper end member of the column, and wherein the luminaire mounting members are located outwardly of the mounting rod.

51. The space dividing system of claim 50, further comprising a cover arrangement engageable with the upper end member of the column and defining an internal space within which the mounting rod is received, wherein the cover member is adapted to extend between the ceiling and the upper end member of the column, and wherein each luminaire mounting member is located outwardly of the cover member.

52. A space dividing system, comprising:

a column including a power receptacle arrangement, wherein the column includes an upper end member and is adapted to be positioned within a space having a ceiling, wherein the column defines a height less than the height of the space such that the upper end member is adapted to be spaced below the ceiling;

a variable height engagement arrangement interconnected with the upper end member and adapted for engagement with the ceiling;

at least a pair of partition panels, wherein the pair of partition panels are secured to the column at spaced locations and wherein the power receptacle arrangement is accessible from between the pair of partition panels; and a cover arrangement engageable with the upper end member of the column and adapted to span between the ceiling and the upper end member.

53. The space dividing system of claim 52, wherein the variable height engagement arrangement comprises a mounting rod defining an upper end and a ceiling engagement arrangement secured to the mounting rod upper end, and wherein the cover arrangement defines an internal space within which the mounting rod is received for concealing the mounting rod between the ceiling and the upper end member of the column.

54. The space dividing system of claim 53, wherein the cover arrangement comprises a tubular cover member having a lower end adapted for interconnection with the upper end member of the column, and an upper end adapted for positioning adjacent a downwardly facing surface defined by the ceiling.

55. A space dividing system, comprising:

a column including a power receptacle arrangement, wherein the column includes an upper end member and is adapted to be positioned within a space having a ceiling, wherein the column defines a height less than the height of the space such that the upper end member is adapted to be spaced below the ceiling;

a lighting arrangement interconnected with the upper end member, wherein the lighting arrangement is adapted to be positioned between the ceiling and the upper end member; and at least a pair of partition panels, wherein the pair of partition panels are secured to the column at spaced locations and wherein the power receptacle arrangement is accessible from between the pair of partition panels;

wherein the column further includes a series of vertical structural members located below the upper end member, wherein each partition panel is pivotably interconnected with one of the vertical structural members of the column, and wherein the partition panels are interconnected with the column below the upper end member of the column.

56. The space dividing system of claim 55, further comprising a ceiling engagement arrangement interconnected with the upper end member of the column and extending upwardly therefrom, wherein the ceiling engagement arrangement is adapted to be engaged with the ceiling of the space within which the space dividing system is located.

57. A space dividing system for use in a building space having a ceiling and a floor, comprising:

a column defining an upper end adapted to be spaced below the ceiling and a lower end adapted to be supported by the floor, wherein the column includes a power receptacle arrangement;

a variable height upper connection arrangement interconnected with the column upper end and adapted for engagement with the ceiling; and at least a pair of partition panels adapted for mounting to the column;

wherein the column includes an upper end member, and wherein the variable height upper connection arrangement comprises a mounting rod receivable within a sleeve interconnected with the upper end member, wherein the mounting rod defines an upper end and wherein the variable height upper connection arrangement includes a ceiling connection arrangement secured to the upper end of the mounting rod and engageable with the ceiling, wherein the mounting rod is longitudinally movable within a passage defined by the sleeve for varying the elevation of the ceiling connection arrangement relative to the upper end member, and further comprising a locking arrangement for selectively fixing the mounting rod to the sleeve for preventing relative movement between the mounting rod and the upper end member when the ceiling connection arrangement is engaged with the ceiling.

58. A space dividing system, comprising:

a columnar assembly including an upper end member, a lower end member, and a plurality of vertical structural members interconnected with the upper and lower members and extending therebetween;

a plurality of partition panels;

a pivot connection arrangement engaged with at least one of the partition panels and with one of the plurality of vertical structural members for pivotably mounting the partition panel to the columnar assembly; and column cover structure engageable with the vertical structural members for concealing an internal space defined by the column between the upper and lower end members, wherein the column cover structure comprises a series of cover members, wherein each cover member is engageable with and between a pair of vertical structural members, wherein each cover member includes outer wall structure extending between a pair of engagement members, wherein each engagement member is engageable with one of the vertical structural members, and wherein the engagement members are releasably engageable with a pair of the vertical structural members in response to application of an inward push-on force to the cover member.

59. A space dividing system, comprising:

a columnar assembly including an upper end member, a lower end member, and a plurality of vertical structural members interconnected with the upper and lower members and extending therebetween;

a plurality of partition panels; and a pivot connection arrangement engaged with at least one of the partition panels and with one of the plurality of vertical structural members for pivotably mounting the partition panel to the columnar assembly;

wherein each partition panel includes a structural frame assembly defining an upper end and a lower end adjacent the columnar assembly, and wherein the pivot connection comprises upper and lower pivot assemblies mounted to one of the vertical structural members and interconnected with the upper and lower ends, respectively of the partition panel frame assembly;

wherein each pivot assembly comprises a pivot connection member adapted for mounting to one of the vertical structural members, wherein the pivot connection member includes a longitudinally extending pivot shaft offset from the vertical structural member, and a pivot receiver mounted to the structural frame assembly and defining a vertical recess within which the pivot shaft is received, for providing pivoting movement of the partition panel about a vertical pivot axis offset from a vertical longitudinal axis defined by the vertical structural member of the columnar assembly.

60. A space dividing system comprising:

a columnar assembly including an upper end member, a lower end member, and a plurality of vertical structural members interconnected with the upper and lower members and extending therebetween;

a plurality of partition panels; and a pivot connection arrangement engaged with at least one of the partition panels and with one of the plurality of vertical structural members for pivotably mounting the partition panel to the columnar assembly;

wherein the columnar assembly defines a height less than the height of a space within which the space dividing system is adapted to be positioned such that the upper end member is adapted to be spaced below a ceiling arrangement associated with the space, and further comprising a variable height engagement arrangement interconnected with the upper end member and adapted for engagement with the ceiling, wherein the variable height engagement arrangement comprises a mounting rod receivable within a sleeve interconnected with the upper end member, wherein the mounting rod defines an upper end and wherein the variable height engagement arrangement includes a ceiling engagement arrangement secured to the upper end of the mounting rod, wherein the mounting rod is longitudinally movable within a passage defined by the sleeve for varying the elevation of the ceiling engagement arrangement relative to the upper end member, and further comprising a locking arrangement for selectively fixing the mounting rod to the sleeve for preventing relative movement between the mounting rod and the upper end member when the ceiling engagement arrangement is adapted to be engaged with the ceiling.

61. A space dividing system for use in a space including a floor, comprising:

a columnar assembly adapted for engagement with the floor, wherein the columnar assembly includes an upper end member, a lower end member, and a plurality of vertical structural members interconnected with the upper and lower members and extending therebetween;

a plurality of partition panels, wherein each partition panel includes a pair of vertical side frame members and top and bottom transverse frame members extending between the side frame members, wherein the partition panels include a floor engagement arrangement separate from the columnar assembly adapted for engagement with the floor separately from the columnar assembly;

a pivot connection arrangement interposed between each partition panel and one of the vertical structural members of the columnar assembly for pivotably mounting each partition panel to the columnar assembly;

wherein the column defines a height less than the height of the space within which the space dividing system is positioned such that the upper end member is adapted to be spaced below a ceiling associated with the space;

a variable height engagement arrangement interconnected with the upper end member and adapted for engagement with the ceiling; and one or more luminaires mounted to the upper end member of the column.

62. A space dividing system, comprising:

a columnar assembly including an upper end member, a lower end member, and a plurality of vertical structural members interconnected with the upper and lower members and extending therebetween;

a plurality of partition panels;

a pivot connection arrangement engaged with at least one of the partition panels and with one of the plurality of vertical structural members for pivotably mounting the partition panel to the columnar assembly;

wherein the columnar assembly defines a height less than the height of a space within which the space dividing system is adapted to be positioned such that the upper end member is adapted to be spaced below a ceiling arrangement associated with the space, and further comprising a variable height engagement arrangement interconnected with the upper end member and adapted for engagement with the ceiling; and one or more luminaires for mounting to the upper end member of the columnar assembly, wherein each luminaire comprises a lighting member secured to a mounting member, wherein the mounting member is adapted for engagement with the upper end member of the columnar assembly and is configured such that the lighting member is located exteriorly of the columnar assembly and spaced outwardly therefrom.

63. The space dividing system of claim 61, wherein the variable height engagement arrangement comprises a mounting rod adapted for engagement with the upper end member of the column, and wherein each luminaire mounting member is located outwardly of the mounting rod.

64. A space dividing system, comprising:

a columnar assembly including an upper end member, a lower end member, and a plurality of vertical structural members interconnected with the upper and lower members and extending therebetween;

a plurality of partition panels;

a pivot connection arrangement engaged with at least one of the partition panels and with one of the plurality of vertical structural members for pivotably mounting the partition panel to the columnar assembly;

wherein the columnar assembly defines a height less than the height of a space within which the space dividing system is adapted to be positioned such that the upper end member is adapted to be spaced below a ceiling arrangement associated with the space, and further comprising a variable height engagement arrangement interconnected with the upper end member and adapted for engagement with the ceiling; and a cover arrangement engageable with the upper end member of the columnar assemble and adapted to span between the ceiling and the upper end member.

65. The space dividing system of claim 64, wherein the variable height engagement arrangement comprises a mounting rod defining an upper end and a ceiling engagement arrangement secured to the mounting rod upper end, and wherein the cover arrangement defines an internal space within which the mounting rod is received for concealing the mounting rod between the ceiling and the upper end member of the column.

66. A space dividing system, comprising:

a columnar assembly including an upper end member, a lower end member, and a plurality of vertical structural members interconnected with the upper and lower members and extending therebetween;

a plurality of partition panels;

a pivot connection arrangement engaged with at least one of the partition panels and with one of the plurality of vertical structural members for pivotably mounting the partition panel to the columnar assembly;

wherein the columnar assembly is adapted to be positioned within a space having a ceiling, and wherein the columnar assembly defines a height less than the height of the space such that the upper end member is adapted to be spaced below the ceiling; and a lighting arrangement interconnected with the upper end member, wherein the lighting arrangement is adapted to be positioned between the ceiling and the upper end member, and wherein the partition panels are interconnected with the column below the upper end member of the column.

* * * * *

UNITED STATES PATENT AND TRADEMARK OFFICE

CERTIFICATE OF CORRECTION

PATENT NO. : 6,571,519 B1
DATED : June 3, 2003
INVENTOR(S) : Niels Diffrient et al.

It is certified that error appears in the above-identified patent and that said Letters Patent is hereby corrected as shown below:

Column 19,
Line 61, delete “8” and substitute therefore -- 2 --;

Column 29,
Line 56, after “respectively” insert -- , --;

Column 31,
Line 22, delete “61” and substitute therefore -- 62 --;

Column 32,
Line 7, delete “assemble” and substitute therefore -- assembly --.

Signed and Sealed this

Eighteenth Day of November, 2003

JAMES E. ROGAN
*Director of the United States Patent and Trademark Office*